US007974431B2

(12) United States Patent
Saiki

(10) Patent No.: US 7,974,431 B2
(45) Date of Patent: Jul. 5, 2011

(54) SPEAKER SYSTEM

(75) Inventor: Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 1148 days.

(21) Appl. No.: 11/662,608

(22) PCT Filed: Sep. 13, 2005

(86) PCT No.: PCT/JP2005/016806

§ 371 (c)(1),
(2), (4) Date: Mar. 13, 2007

(87) PCT Pub. No.: WO2006/030760

PCT Pub. Date: Mar. 23, 2006

(65) Prior Publication Data

US 2007/0201712 A1 Aug. 30, 2007

(30) Foreign Application Priority Data

Sep. 13, 2004 (JP) ..... 2004-265546

(51) Int. Cl.
*H04R 1/02* (2006.01)
*H04R 1/20* (2006.01)

(52) U.S. Cl. ..... 381/386; 381/338; 381/345

(58) Field of Classification Search ..... 381/163, 381/186, 335, 337, 338, 349, 351–354, 386; 181/144, 147, 155–157, 160, 199
See application file for complete search history.

(56) References Cited

U.S. PATENT DOCUMENTS

| | | | |
|---|---|---|---|
| 5,371,805 | A | 12/1994 | Saiki et al. |
| 5,850,460 | A | 12/1998 | Tanaka et al. |
| 2001/0026628 | A1 | 10/2001 | D'Hoogh |

FOREIGN PATENT DOCUMENTS

| | | |
|---|---|---|
| JP | 56-108684 | 8/1981 |
| JP | 57-4888 | 1/1982 |
| JP | 57-176793 | 11/1982 |
| JP | 60-142593 | 9/1985 |
| JP | 60-177798 | 9/1985 |
| JP | 1-82587 | 6/1989 |
| JP | 1-146692 | 10/1989 |
| JP | 1-146693 | 10/1989 |
| JP | 2-79692 | 6/1990 |
| JP | 4-248799 | 9/1992 |
| JP | 5-260581 | 10/1993 |
| JP | 5-292594 | 11/1993 |
| JP | 6-315194 | 11/1994 |
| JP | 8-79876 | 3/1996 |
| JP | 9-37376 | 2/1997 |
| JP | 2003-529251 | 9/2003 |

*Primary Examiner* — Tuan Nguyen
(74) *Attorney, Agent, or Firm* — Wenderoth, Lind & Ponack, L.L.P.

(57) ABSTRACT

A speaker system of the present invention comprises a cabinet, at least one speaker unit attached to the cabinet, and a plurality of passive radiators attached to the cabinet and each including a diaphragm and a supporting system supporting the diaphragm. The speaker system of the present invention is configured so that distortion components of sound pressures radiated from the supporting systems of the plurality of passive radiators are canceled with each other, and sounds radiated by the plurality of passive radiators are radiated in substantially the same direction from the cabinet.

30 Claims, 22 Drawing Sheets

| SYMBOL | WEIGHT BALANCE OF DIAPHRAGM | RESONANT RREQUENCY[Hz] | ROLLIMG RREQUENCY[Hz] |
|---|---|---|---|
| α |  | 11.8 | 18.2 |
| β |  | 11.8 | 28.8 |
| γ |  | 11.8 | 14.8 |

SPEAKER SYSTEM

TECHNICAL FIELD

The present invention relates to a speaker system, and more particularly, to a passive radiator speaker system which reduces a distortion in a low-frequency sound range.

BACKGROUND ART

In conventional passive radiator speaker systems for reproduction of a low-frequency sound, a single passive radiator is generally used along with a drive speaker unit in a cabinet. However, to reduce a distortion within a low-frequency sound range, a method of using two passive radiators has been proposed (see, for example, see Patent Document 1).

FIG. 21 is a cross-sectional view illustrating a structure of a major portion of a speaker system disclosed in Patent Document 1. In FIG. 21, 1 indicates a cabinet, 2 indicates a drive speaker unit attached inside the cabinet 1, 3 indicates a first passive radiator attached to the cabinet 1, 4 indicates a second passive radiator attached to the cabinet 1, facing the first passive radiator, and 5 indicates an internal space of the cabinet 1 to which the first passive radiator 3 and the second passive radiator 4 are attached.

An operation of the thus-configured speaker system will be described. When an electrical signal is applied to the drive speaker unit 2, a sound is radiated from the diaphragm of the drive speaker unit 2. The pressure of the radiated sound vibrates the first passive radiator 3 and the second passive radiator 4 acoustically coupled via the space 5, so that a sound is radiated to an external space outside the cabinet 1. In this case, since the first passive radiator 3 and the second passive radiator 4 are attached to surfaces facing each other of the cabinet 1, the vibration of the cabinet 1 caused by the vibration of the first passive radiator 3 and the vibration of the cabinet 1 caused by the vibration of the second passive radiator 4 are canceled with each other, so that the vibration of the cabinet 1 caused by the vibration of the passive radiator can be prevented.

Since passive radiators do not have a drive system including a voice coil, a magnetic circuit and the like, unlike speaker units, the nonlinearity of the support system would be a major cause of the occurrence of a distortion. In the design of speaker units, consideration needs to be given so as to stabilize the vibration of the voice coil so that the voice coil is prevented from contacting and damaging a magnetic gap of the magnetic circuit. In the design of passive radiators, a drive system including a voice coil, a magnetic circuit and the like is not possessed, and therefore, such consideration is not required, and only consideration is given so as to improve the linearity of a supporting force of the supporting system. Also, the limit of low-frequency sound reproduction of a passive radiator is determined by the acoustic antiresonance of the weight of the vibration system of the passive radiator and the air in the cabinet. In this case, the stiffness of the supporting system of the passive radiator needs to be sufficiently small as compared to the stiffness of the air in the cabinet.

The supporting system of a passive radiator includes a damper supporting a center portion of a diaphragm and an edge supporting an outer circumferential portion of the diaphragm. The edge may have various shapes. The most widely used edge is a roll edge which has a semicircular cross-section. When the roll edge is employed, the diaphragm can be supported while keeping the linearity of the supporting force even if the diaphragm is vibrated with a large amplitude.

Note that, as disclosed in Patent Document 2, the roll-shaped edge has different displacements of air in the vertical amplitude direction, and therefore, even if the supporting force is linear, a sound radiated from the edge includes a distortion component.

In the speaker system described in Patent Document 1 above, as illustrated in FIG. 21, the front-to-rear direction with respect to the radiation direction of a sound of the first passive radiator 3 is opposite to the front-to-rear direction with respect to the radiation direction of a sound of the second passive radiator 4. In other words, while the first passive radiator 3 radiates a sound from the front surface to the external space, the second passive radiator 4 radiates a sound from the rear surface to the external space. As a result, an asymmetrical distortion included in the sound radiated to the external space from the first passive radiator 3 and an asymmetrical distortion included in the sound radiated to the external space from the second passive radiator 4 are canceled with each other, so that the distortion caused by the roll shape of the edge as described above is reduced.

Patent Document 1: Japanese Laid-Open Patent Publication No. 8-79876

Patent Document 2: Japanese Laid-Open Patent Publication No. 5-260581

SUMMARY OF THE INVENTION

Problems to be Solved by the Invention

However, in the conventional speaker system of FIG. 21, a distortion is not sufficiently reduced, depending on a user's listening position. Specifically, since the first passive radiator 3 and the second passive radiator 4 are attached to the surfaces facing each other of the cabinet 1, the sound radiated by the first passive radiator 3 and the sound radiated by the second passive radiator 4 are directed toward the front and the rear of the cabinet 1, respectively. Therefore, depending on the listening position, a difference occurs between a distance until the sound radiated by the first passive radiator 3 reaches the user and a distance until the sound radiated by the second passive radiator 4 reaches the user, and resultant asymmetrical distortions in the sounds cannot be sufficiently canceled with each other.

FIG. 22 illustrates the results of measurements performed in a speaker system in which a speaker unit having a diameter of 8 cm (a speaker unit having a vibration system) is attached to a relatively compact cabinet having a height of 206 mm, a width of 122 mm, and a depth of 65 mm, and a passive radiator having a diameter of 12 cm is attached to the same surface to which the speaker unit is attached, when a microphone is placed at a distance of 1 m from the cabinet and in the front of the cabinet (i.e., in the direction of a surface to which the passive radiator is attached) to measure sound pressure-frequency characteristics, and when a microphone is placed at a distance of 1 m from the cabinet and in the rear of the cabinet (i.e., in the direction of a surface opposite to the surface to which the passive radiator is attached) to measure sound pressure-frequency characteristics. In FIG. 22, g indicates the result of measurement in the front of the cabinet, while h indicates the result of measurement in the rear of the cabinet. Although it has been considered that the directivity of a sound is low within a low-frequency sound range of 100 Hz or less corresponding to a sound radiated from passive radiators, it is found from the results of FIG. 22 that a difference in level occurs between a sound pressure measured in the front of the passive radiator and a sound pressure measured in the rear of the passive radiator. Accordingly, when two passive radiators are attached to surfaces facing to each other of a cabinet as in FIG. 21, a difference in sound pressure level occurs between the passive radiators and a phase difference also occurs due to a difference in path, depending on the listening position. Therefore, it is found that asymmetrical distortions cannot be sufficiently canceled with each other in each case.

Also, the conventional passive radiator comprises a damper supporting the center portion of the diaphragm in addition to the diaphragm and the edge. By providing the damper, the occurrence of the rolling phenomenon is suppressed. However, since the diaphragm is supported by the two supporting systems, i.e., the edge and the damper, it is difficult to cause the stiffness of the supporting system for the passive radiator to be sufficiently small as compared to the stiffness of the air inside the cabinet. Therefore, it is difficult to reduce the resonant frequency of the passive radiator itself, so that the limit of reproduction of a low-frequency sound is limited by the resonant frequency.

Also, in Patent Document 2, distortions radiated from the edges of the two speaker units are canceled with each other. However, in the speaker unit, there is a distortion in a driving force generated in the voice coil as a cause of the occurrence of a distortion as described above. Therefore, even if the distortion of the radiated sound of the edge can be removed, the driving force distortion still remains.

Therefore, an object of the present invention is to achieve a speaker system having a lower distortion.

Solution to the Problems

The present invention has the following features to attain the object mentioned above. Note that reference numerals and figure numbers inside parentheses indicate correspondence to the drawings described below for the sake of easy understanding, and do not limit the present invention.

A first aspect of the present invention is directed to a speaker system which is configured so that distortion components of sound pressures radiated from supporting systems (24, 27) of a plurality of passive radiators (22, 25) are canceled with each other, and sounds radiated by the plurality of passive radiators are radiated in substantially the same direction from a cabinet.

In a second aspect of the present invention based on the first aspect, the plurality of passive radiators are attached to the same surface of the cabinet (20) (FIG. 1).

In a third aspect of the present invention based on the first aspect, a guide structure is provided for guiding the sounds radiated by the plurality of passive radiators to be radiated in substantially the same direction from the cabinet (FIGS. 6 and 7).

In a fourth aspect of the present invention based on the third aspect, as the guide structure, a reflector (30, 41, 43) is provided in front of the passive radiator via a gap, and an opening (31, 42) for radiating, in a particular direction, the sound radiated by the passive radiator and reflected by the reflector is provided.

In a fifth aspect of the present invention based on the first aspect, edges included in the supporting systems of two passive radiators of the plurality of passive radiators each have a cross-sectional shape substantially symmetrical about a surface to which the passive radiators are attached.

In a sixth aspect of the present invention based on the fifth aspect, the cross-sectional shapes of the edges included in the supporting systems of the two passive radiators are roll shapes which are convex and concave with respect to the surface to which the passive radiators are attached, respectively.

A seventh aspect of the present invention is directed to a speaker system in which a supporting system is configured so that a distortion component of a sound pressure radiated from a portion of a supporting system of a passive radiator (60, 70, 80) is canceled with a distortion component of a sound pressure radiated from another portion of the supporting system of the passive radiator (FIGS. 8, 10, 17).

In an eighth aspect of the present invention based on the seventh aspect, an edge (62) included in the supporting system of the passive radiator is divided into a plurality of edge pieces (62*a*, 62*b*, 62*c*) along an outer circumference direction, and two edge pieces (62*a*, 62*b*) of the plurality of edge pieces each have a cross-sectional shape substantially symmetrical about a surface to which the passive radiator is attached.

In a ninth aspect of the present invention based on the eighth aspect, a center-of-gravity position of the diaphragm in a vibration direction of the diaphragm coincides with a center position of a height dimension of the edge in the vibration direction of the diaphragm (FIGS. 11, 12).

In a tenth aspect of the present invention based on the eighth aspect, the passive radiator has a structure in which an inner circumferential portion of the edge is joined with an outer circumferential portion of the diaphragm to be fixed, and the diaphragm has a structure in which a portion thereof joined with the inner circumferential portion of the edge has a thickness thinner than that of a center portion of the diaphragm (FIG. 12).

In an eleventh aspect of the present invention based on the eighth aspect, the passive radiator has a structure in which the inner circumferential portion of the edge is sandwiched by the outer circumferential portion of the diaphragm to be fixed (FIG. 11).

In a twelfth aspect of the present invention based on the eighth aspect, a center portion of the diaphragm has a mass per unit area larger than that of an outer circumferential portion of the diaphragm (FIGS. 13 and 16).

In a thirteenth aspect of the present invention based on the twelfth aspect, a center-of-gravity position of the diaphragm in a vibration direction of the diaphragm coincides with a center position of a height dimension of the edge in the vibration direction of the diaphragm.

In a fourteenth aspect of the present invention based on the twelfth aspect, the center portion of the diaphragm has a thickness thicker than that of the outer circumferential portion of the diaphragm (FIGS. 13 and 16).

In a fifteenth aspect of the present invention based on the fourteenth aspect, the diaphragm is in the shape of a circle, and the diaphragm has a thickness which is reduced from a center point of the diaphragm toward an outer circumference of the diaphragm (FIG. 13).

In a sixteenth aspect of the present invention based on the fourteenth aspect, the diaphragm is in the shape of a square, and the diaphragm has a thickness which is reduced from a center point of the diaphragm toward an outer side of the diaphragm.

In a seventeenth aspect of the present invention based on the fourteenth aspect, the diaphragm is in the shape of a rectangle, and the diaphragm has a thickness which is reduced from a center line in a longer side direction of the diaphragm toward two longer sides of the diaphragm.

In an eighteenth aspect of the present invention based on the fourteenth aspect, the diaphragm is in the shape of a track, and the diaphragm has a thickness which is reduced from a center line in a longitudinal direction of the diaphragm toward two sides of the diaphragm (FIG. 16).

In a nineteenth aspect of the present invention based on the eighth aspect; the passive radiator further has a weight having a specific gravity larger than a specific gravity of the diaphragm, the weight being fixed on at least one surface of a center portion of the diaphragm (FIG. 15).

In a twentieth aspect of the present invention based on the nineteenth aspect, a center-of-gravity position of the diaphragm in a vibration direction of the diaphragm coincides with a center position of a height dimension of the edge in the vibration direction of the diaphragm.

In a twenty-first aspect of the present invention based on the nineteenth aspect, the diaphragm is in the shape of a circle, and the weight is in the shape of a circle having a diameter smaller than that of the diaphragm, and is fixed with a center point thereof coinciding with a center point of the diaphragm (FIG. 15).

In a twenty-second aspect of the present invention based on the nineteenth aspect, the diaphragm is in the shape of a square, and the weight is in the shape of a square having a side length shorter than that of the diaphragm, and is fixed with a center point thereof coinciding with a center point of the diaphragm and each side of the weight being opposed to a corresponding side of the diaphragm.

In a twenty-third aspect of the present invention based on the nineteenth aspect, the diaphragm is in the shape of a rectangle, and the weight is in the shape of a rectangle having an outer shape smaller than that of the diaphragm, and is fixed with a center line in a longer side direction thereof coinciding with that of the diaphragm.

In a twenty-fourth aspect of the present invention based on the nineteenth aspect, the diaphragm is in the shape of a track, and the weight is in the shape of a rectangle having an outer shape smaller than that of the diaphragm, and is fixed with a center line in a longer side direction thereof coinciding with a center line in a longitudinal direction of the diaphragm.

In a twenty-fifth aspect of the present invention based on the eighth aspect, the cross-sectional shapes of the two edges are roll shapes which are convex and concave with respect to the surface to which the passive radiator is attached, respectively.

In a twenty-sixth aspect of the present invention based on the seventh aspect, the passive radiator has an annular diaphragm (81), an inner edge (82*a*) supporting an inner circumference of the diaphragm, and an outer edge (82*b*) supporting an outer circumference of the diaphragm, and the inner edge and the outer edge have cross-sectional shapes with which distortion components of sound pressures radiated from the inner edge and the outer edge are canceled with each other.

In a twenty-seventh aspect of the present invention based on the twenty-sixth aspect, one of the inner edge and the outer edge has a cross-sectional shape which is a roll shape convex with respect to a surface to which the passive radiator is attached, and the other has a cross-sectional shape which is a roll shape concave with respect to the surface to which the passive radiator is attached.

A twenty-eighth aspect of the present invention is directed to a video audio apparatus (90) comprising the speaker system according to anyone of claims 1 to 27, and a guide structure for guiding a sound radiated by the passive radiator of the speaker system toward a screen (91) of a display device by a reflector provided in front of the passive radiator via a gap.

A twenty-ninth aspect of the present invention is directed to a car comprising the speaker system according to any one of claims 1 to 27, and a body of the car for holding the speaker system thereinside (FIGS. 19, 20).

Effect of the Invention

According to the present invention, it is possible to achieve a speaker system and a video audio apparatus in which a distortion caused by a supporting system of a passive radiator is sufficiently canceled irrespective of a listening position, so that a low-frequency sound having a low distortion can be reproduced.

DESCRIPTION OF THE REFERENCE CHARACTERS

Figure 1:
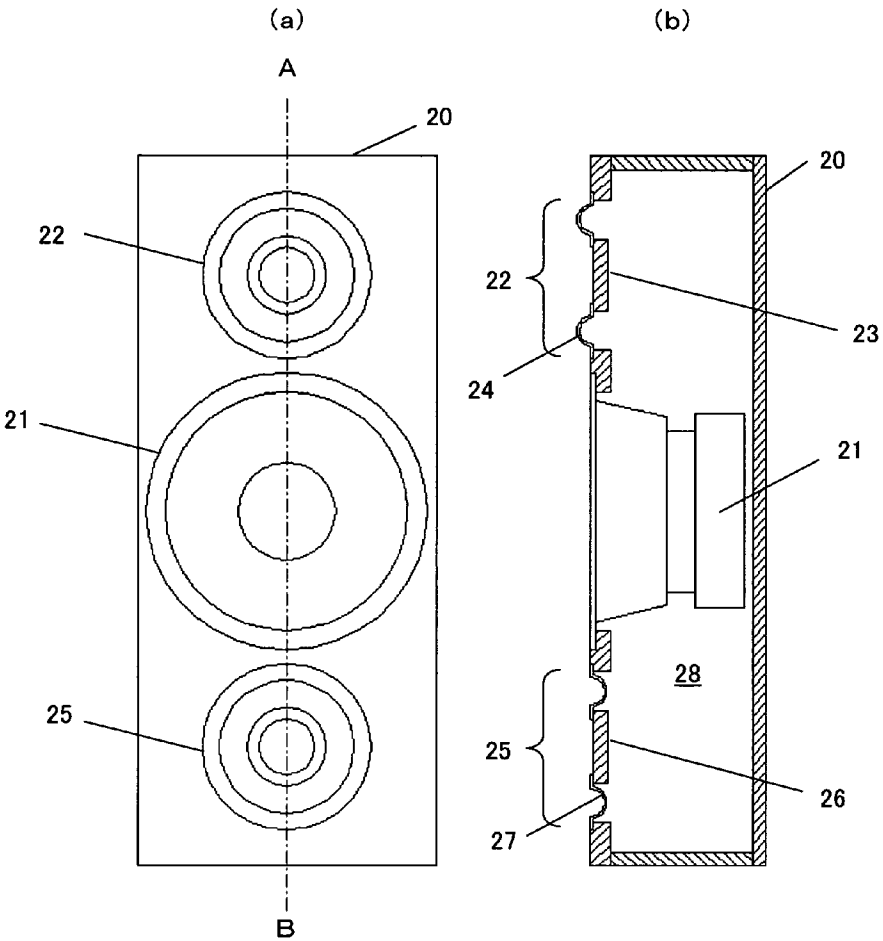
FIG. 1 is a diagram illustrating a configuration of a speaker system according to Embodiment 1 of the present invention.

20, 152 cabinet
21 speaker unit
22, 25, 60, 70, 80, 103 passive radiator
23, 26, 61, 71, 150 diaphragm
24, 151 convex edge
27 concave edge
28 volume
30 reflector
31, 42, 44, 93, 94 opening
40 surface
41, 43 reflector
62, 72 edge
62*a*, 72*a* convex roll portion
62*b*, 72*b* concave roll portion
62*c*, 72*c* connection portion
611, 713 weight portion
612, 613 weight
711 groove
712 planar portion
81 ring-shaped diaphragm
82*a* inner edge
82*b* outer edge
83 frame
84 air hole
90 PDP main body
91 screen portion
92 housing
95, 96 high-frequency speaker

DETAILED DESCRIPTION OF THE INVENTION

Hereinafter, embodiments of the present invention will be described with reference to the accompanying drawings.

Embodiment 1

FIG. 1 illustrates a configuration of a speaker system according to Embodiment 1 of the present invention. Particularly, (a) is a front view of the speaker system, and (b) is a cross-sectional view of the speaker system, taken along line A-B. Also, 20 indicates a cabinet, 21 indicates a speaker unit, 22 indicates a first passive radiator, 23 indicates a diaphragm which is a component of the first passive radiator 22, 24 indicates a roll-shaped convex edge which is a component of the first passive radiator 22, 25 indicates a second passive radiator, 26 indicates a diaphragm which is a component of the second passive radiator 25, 27 indicates a roll-shaped concave edge which is a component of the second passive radiator 25, and 28 indicates a volume of the cabinet 20. Note that the first and second passive radiators 22 and 25 of FIG. 1 are, for example, circular passive radiators.

An operation of the thus-configured speaker system will be described.

The operation of the speaker unit 21, which is an electrodynamic speaker, is well known and will not be herein described in detail. For example, when a music signal is applied to the speaker unit 21, a force is generated in the voice coil to vibrate the cone-shaped diaphragm, thereby generating a sound. A sound pressure generated by the cone-shaped diaphragm is radiated in the volume 28 of the cabinet 20. The sound pressure vibrates the first passive radiator 22 and the second passive radiator 25, thereby generating sounds.

Figure 2:
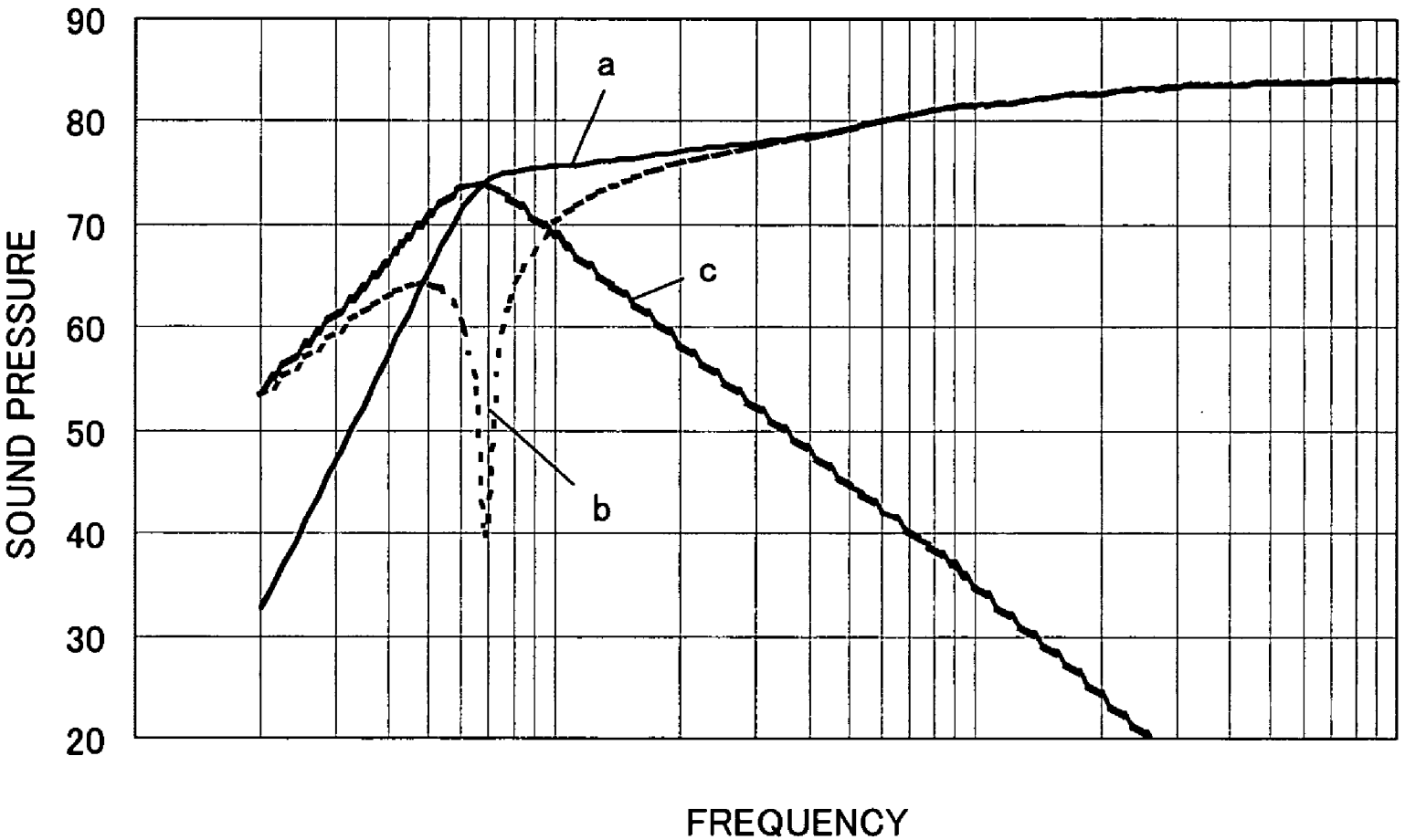
FIG. 2 is a diagram illustrating sound pressure-frequency characteristics of a passive radiator speaker system.

Such a passive radiator speaker system radiates a sound having a frequency band which has sound pressure-frequency characteristics as illustrated in FIG. 2. In FIG. 2, the horizontal axis indicates frequencies, the vertical axis indicates sound pressure levels, a indicates the characteristics of the whole speaker system, b indicates the characteristics of a sound radiated only from the speaker unit, and c indicates the characteristics of a sound radiated only from the passive radiator. The characteristics a of the whole speaker system is a combination (addition) of the characteristics b of the sound radiated only from the speaker unit and the characteristics c of the sound radiated only from the passive radiator. According to the characteristics of FIG. 2, it is found that the passive radiator speaker system has a low-frequency sound range within which the diaphragm of the speaker unit is halted by antiresonance between the weight of the vibration system of the passive radiator and the stiffness of the air in the volume of the cabinet, so that a sound is mainly radiated from the passive radiator. Therefore, a distortion occurring in the speaker unit does not raise a problem within a low-frequency sound range, so that a distortion within a low-frequency sound range of the whole speaker system is determined by a distortion occurring in the passive radiator.

Figure 3:
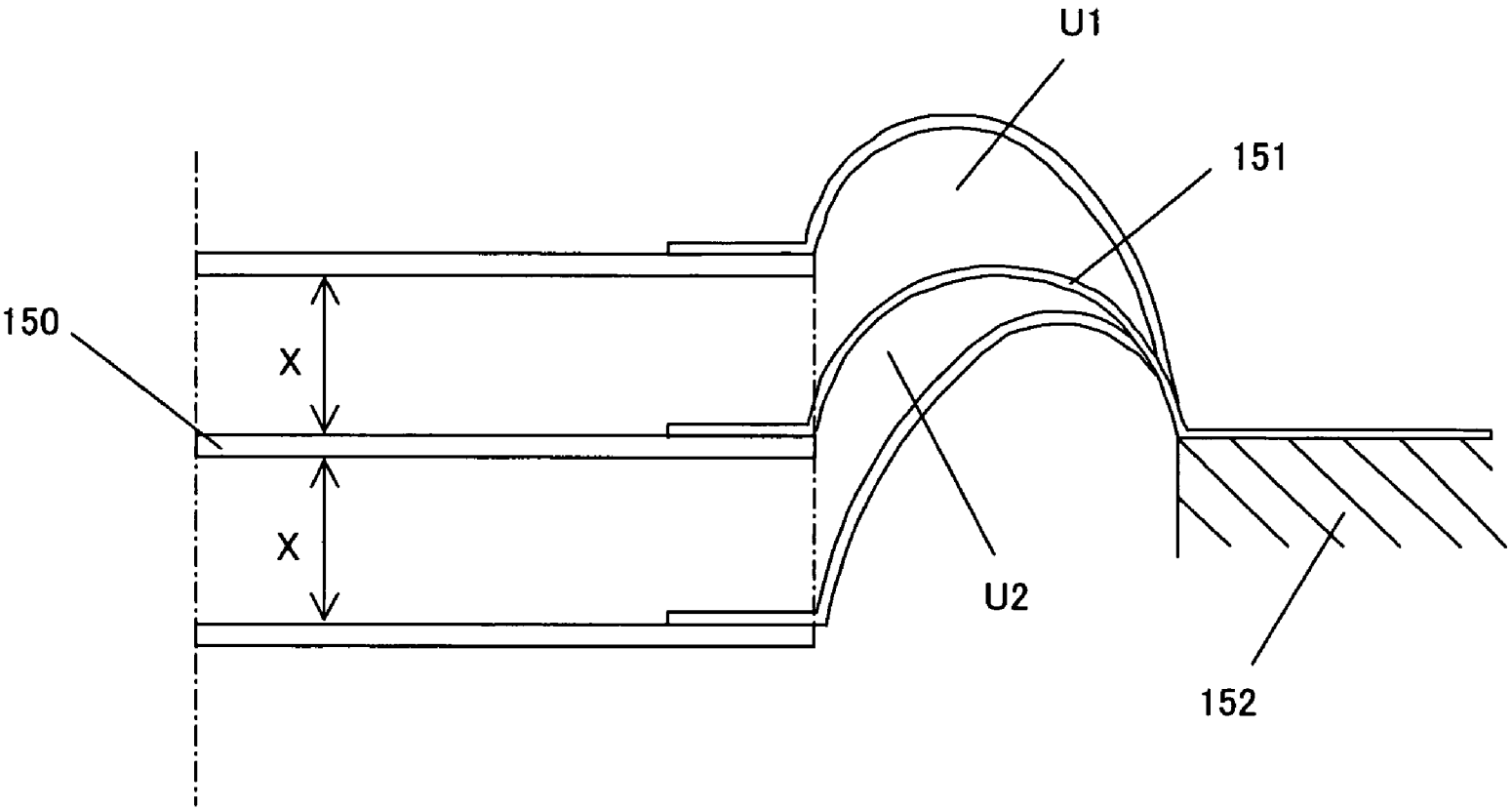
FIG. 3 is a diagram illustrating a vibrating state of a roll edge.

Next, a mechanism of the occurrence of a distortion in the roll-shaped edge will be described with reference to FIG. 3. In FIG. 3, 150 indicates a diaphragm, 151 indicates a convex edge, and 152 indicates a cabinet to which the convex edge 151 is fixed. It is here assumed that the diaphragm 150 is linearly vibrated and moved back and forth in equal distances (X mm). An amount of air displaced when the diaphragm 150 is moved forth by X mm is represented by U1, and an amount of air displaced when the diaphragm 150 is moved back by X mm is represented by U2. In this case, as can be seen from FIG. 3, the air amount U1 and the air amount U2 are different from each other due to the deformation of the convex edge 151. The asymmetry of the air amounts displaced by the edge leads to a distortion in sound pressure.

In this embodiment, the convex edge 24 is used as an edge for supporting the first passive radiator 22, and the concave edge 27 is used as an edge for supporting the second passive radiator 25. The convex edge 24 and the concave edge 27 have cross-sections as if they were turned upside down with respect to each other, i.e., which are symmetrical about a surface to which the passive radiator is attached. Therefore, the amount of air displaced when the diaphragms 23 and 26 are moved to the outside of the cabinet 20 is equal to the amount of air displaced when the diaphragms 23 and 26 are moved to the inside of the cabinet 20, so that distortions in sounds radiated from the first passive radiator 22 and the second passive radiator 25 are canceled with each other.

Also, in this embodiment, the first passive radiator 22 and the second passive radiator 25 are attached to the same surface of the cabinet 20, so that the passive radiators radiate sounds in the same direction (i.e., the forward direction of the speaker system). Therefore, the effect of canceling distortions is not reduced, depending on the listening position, as is different from the conventional speaker system of FIG. 21.

Figure 4:
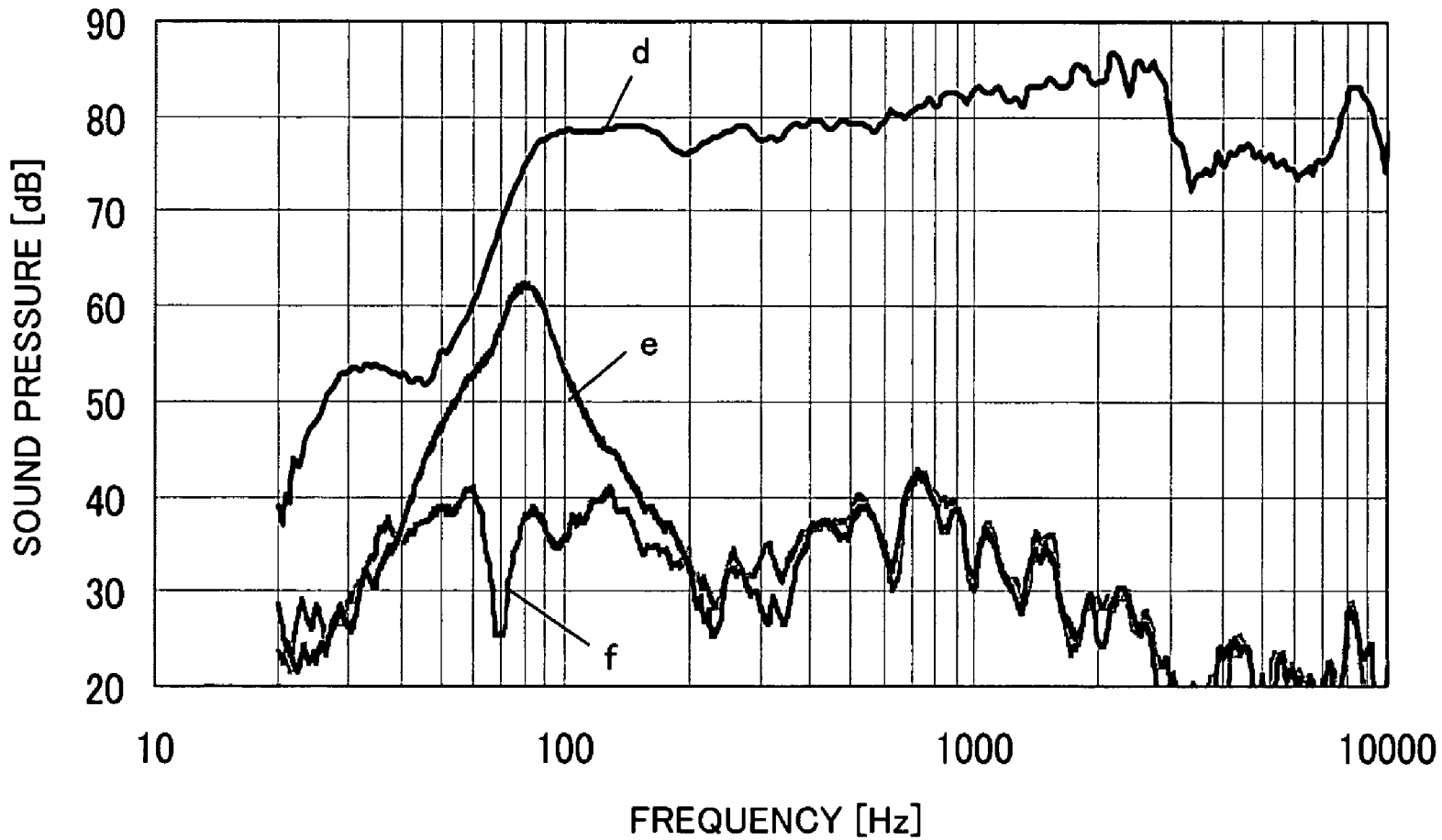
FIG. 4 is a diagram illustrating sound pressure-frequency characteristics of the speaker system of Embodiment 1 of the present invention.

FIG. 4 illustrates the result of actual measurement of sound pressure-frequency characteristics and a second harmonic distortion when, in the speaker system of FIG. 1, a speaker unit having a diameter of 8 cm was used as the speaker unit 21, a passive radiator having a diameter of 6.5 cm was used as each of the first passive radiator 22 and the second passive radiator 25, and a cabinet having a volume of 1.3 liter was used as the cabinet 20. In FIG. 4, d indicates sound pressure-frequency characteristics, and f indicates distortion characteristics. Note that, in FIG. 4, e indicates, as a comparative example, distortion characteristics when the shapes of the edges of the first passive radiator 22 and the second passive radiator 25 were changed to be both convex in the forward direction of the cabinet 20. As can be seen from e of FIG. 4, when the two passive radiators both have a convex-shaped edge, the asymmetry of the amounts of air displayed by the edges causes a large second harmonic distortion in the vicinity of 80 Hz. On the other hand, as can be seen from f of FIG. 4, by combining the convex edge 24 and the concave edge 27, the asymmetry of the air displacements is reduced, so that the level of the second harmonic distortion in the vicinity of 80 Hz is reduced by near 20 dB.

The shape of the edge of the speaker unit 21 has not been heretofore mentioned. However, assuming that the shape of the edge of the speaker unit 21 is of a general roll edge, when the diaphragm of the speaker unit 21 is vibrated, a distortion is considered to occur for the reason as described with respect to FIG. 3. However, as can be seen from b of FIG. 2, the diaphragm of the speaker unit is substantially not vibrated in the vicinity of 80 Hz at which the passive radiator mainly reproduces a sound, so that a distortion component radiated from the edge of the speaker unit is considerably small. As a result, regarding the characteristics of the whole speaker system, which are a combination of the radiated sounds of the speaker unit and the passive radiator, in the configuration of the embodiment, the reproduction band of the low-frequency sound range is broadened by the passive radiator, and further, a distortion within the low-frequency sound range can be significantly reduced.

Although the supporting system of the passive radiator includes only an edge in this embodiment, a damper may be further provided as a supporting system. Even with such a configuration, the effect of reducing a distortion of the edge is not affected.

Also, although the shape of the edge of the passive radiator is in the shape of a roll as illustrated in FIG. 1 in this embodiment, the present invention is not limited to this. Even when an edge is used which has any shape which can generate a distortion by the mechanism of FIG. 3, the present invention can be applied to reduce the distortion.

Also, although the first passive radiator 22 and the second passive radiator 25 are provided with the speaker unit 21 being interposed therebetween in this embodiment, the present invention is not limited to this. The first passive radiator 22 and the second passive radiator 25 may be provided at any positions as long as they are provided on the same surface of the cabinet 20. For example, even when the first passive radiator 22 and the second passive radiator 25 are provided adjacent to each other, an effect similar to that of this embodiment is obtained.

Also, although the speaker unit 21 is provided on the same surface to which the first passive radiator 22 and the second passive radiator 25 are attached in this embodiment, the present invention is not limited to this. The speaker unit 21 may be provided on a surface which is different from the surface to which the first passive radiator 22 and the second passive radiator 25 are attached. Also in this case, an effect similar to that of this embodiment is obtained.

Also, although two passive radiators (i.e., the first passive radiator 22 and the second passive radiator 25) are used in this embodiment, the present invention is not limited to this. Three or more passive radiators may be provided. For example, when four passive radiators are provided, two of the passive radiators have a convex roll-shaped edge, and the other two have a concave roll-shaped edge, so that distortion components occurring in the edges can be effectively canceled with each other.

Also, although the first passive radiator 22 and the second passive radiator 25 are in the shape of a circle in this embodiment, the present invention is not limited to this. The first and second passive radiators 22 and 25 may be in the shape of, for example, a square, a rectangle, other polygons, or a track as long as equal amounts of air are displaced. The track shape is, for example, the shape of a race track in which only two opposite sides of a rectangle are replaced with semicircles.

Embodiment 2

Figure 5:
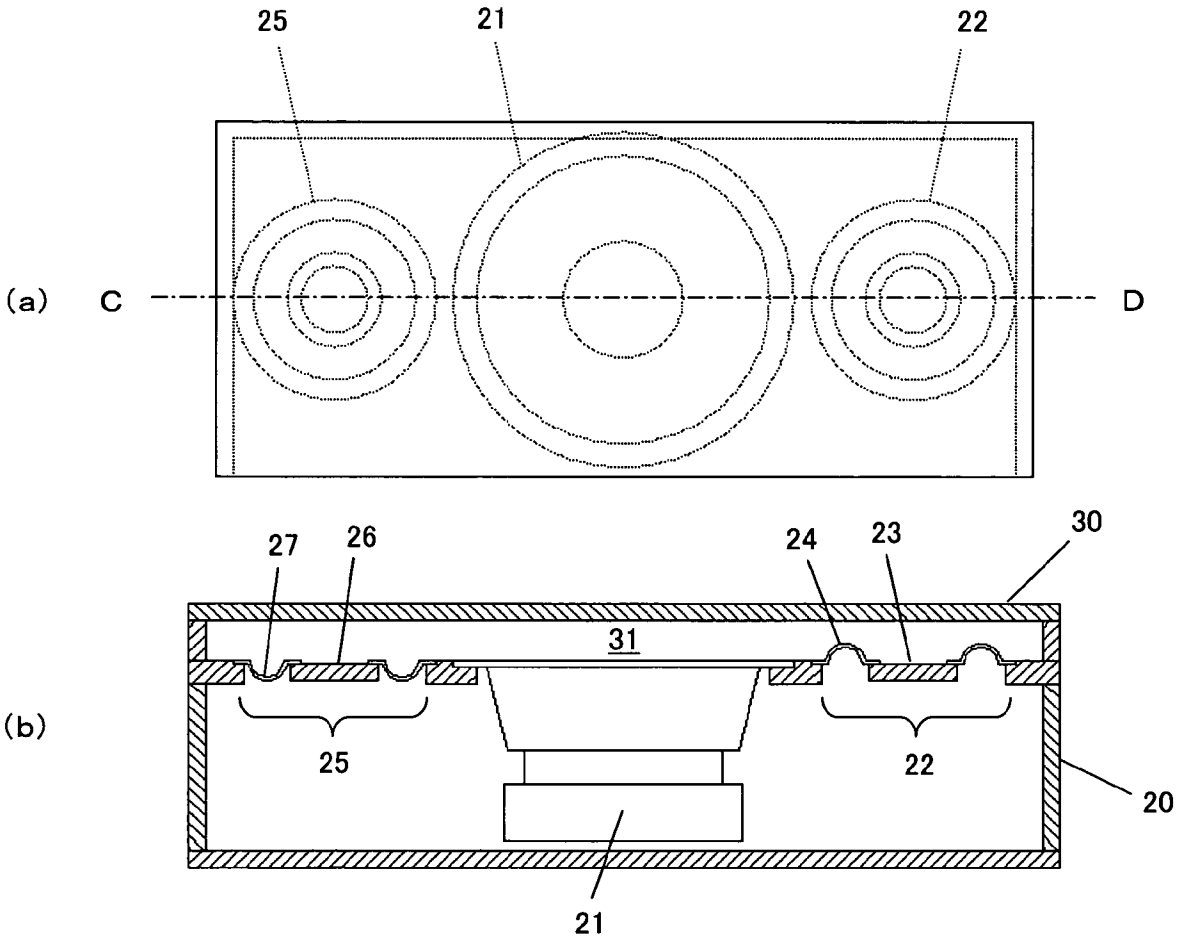
FIG. 5 is a diagram illustrating a configuration of a speaker system according to Embodiment 2 of the present invention.
Figure 6:
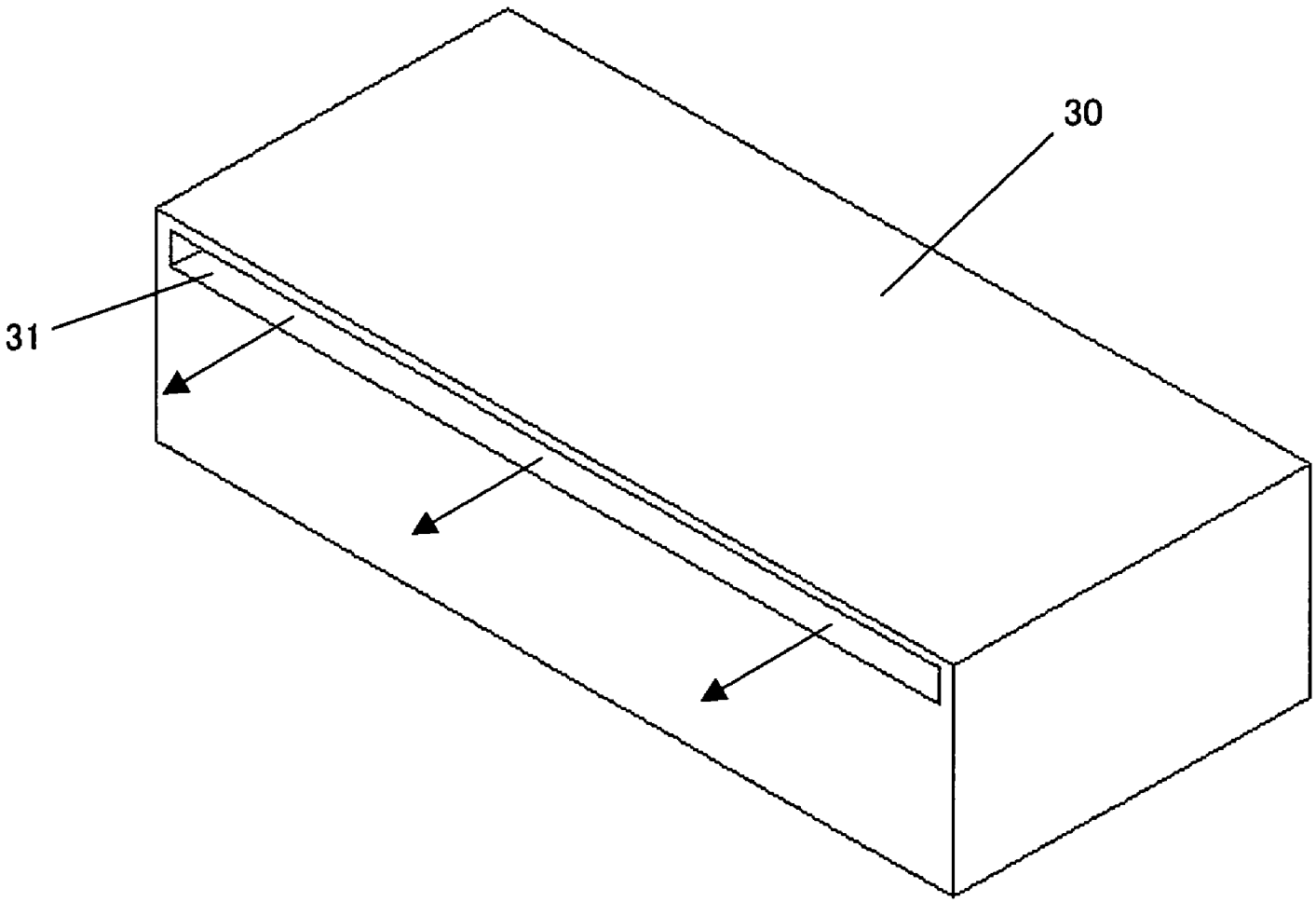
FIG. 6 is an external view of the speaker system of Embodiment 2 of the present invention.

FIG. 5 illustrates a configuration of a speaker system according to Embodiment 2 of the present invention. Particularly, (a) is a front view of the speaker system, and (b) is a cross-sectional view of the speaker system, taken along line C-D. FIG. 6 is an external view of the speaker system. In FIG. 5, components similar to those of FIG. 1 are indicated by the same reference numerals. Embodiment 2 is significantly different from Embodiment 1 in that a sound reflector 30 is provided in front of the first passive radiator 22 and the second passive radiator 25. The reflector 30 is joined with the cabinet 20 so that sounds radiated by the first passive radiator 22 and the second passive radiator 25 are radiated through an opening 31 as indicated by arrows in FIG. 6.

An operation of the thus-configured speaker system will be described.

As in Embodiment 1, the vibration of the speaker unit 21 causes the first passive radiator 22 and the second passive radiator 25 to vibrate to reproduce sounds. In this case, the combination of the convex edge 24 of the first passive radiator 22 and the concave edge 27 of the second passive radiator 25 reduces a distortion within a low-frequency sound range as is similar to Embodiment 1.

Embodiment 2 is different from Embodiment 1 in that, as illustrated by the arrows of FIG. 6, sounds within the low-frequency sound range radiated from the first passive radiator 22 and the second passive radiator 25 are combined by the reflector 30 before being radiated through the opening 31. Thereby, sounds radiated by the convex edge 24 of the first passive radiator 22 and the concave edge 27 of the second passive radiator 25 are forcedly combined in a space formed by the reflector 30 before being radiated in a listening space as in Embodiment 1, so that a distortion due to the asymmetry of the air displacements of the convex edge 24 and the concave edge 27 can be reliably reduced as compared to Embodiment 1.

Although the first passive radiator 22 and the second passive radiator 25 are provided with the speaker unit 21 being interposed therebetween in this embodiment, the present invention is not limited to this. For example, the first passive radiator 22 and the second passive radiator 25 may be provided adjacent to each other.

Also, although the opening 31 is provided along a side of the reflector 30 as illustrated in FIG. 6 in this embodiment, the present invention is not limited to this. For example, an opening may be provided at each of two or more sides of the reflector 30. Also, in this case, sounds radiated by the first passive radiator 22 and the second passive radiator 25 are once combined by the reflector 30 before being radiated through each opening, so that a distortion due to the asymmetry of the air displacements of the convex edge 24 and the concave edge 27 is reliably reduced as compared to Embodiment 1.

Embodiment 3

Figure 7:
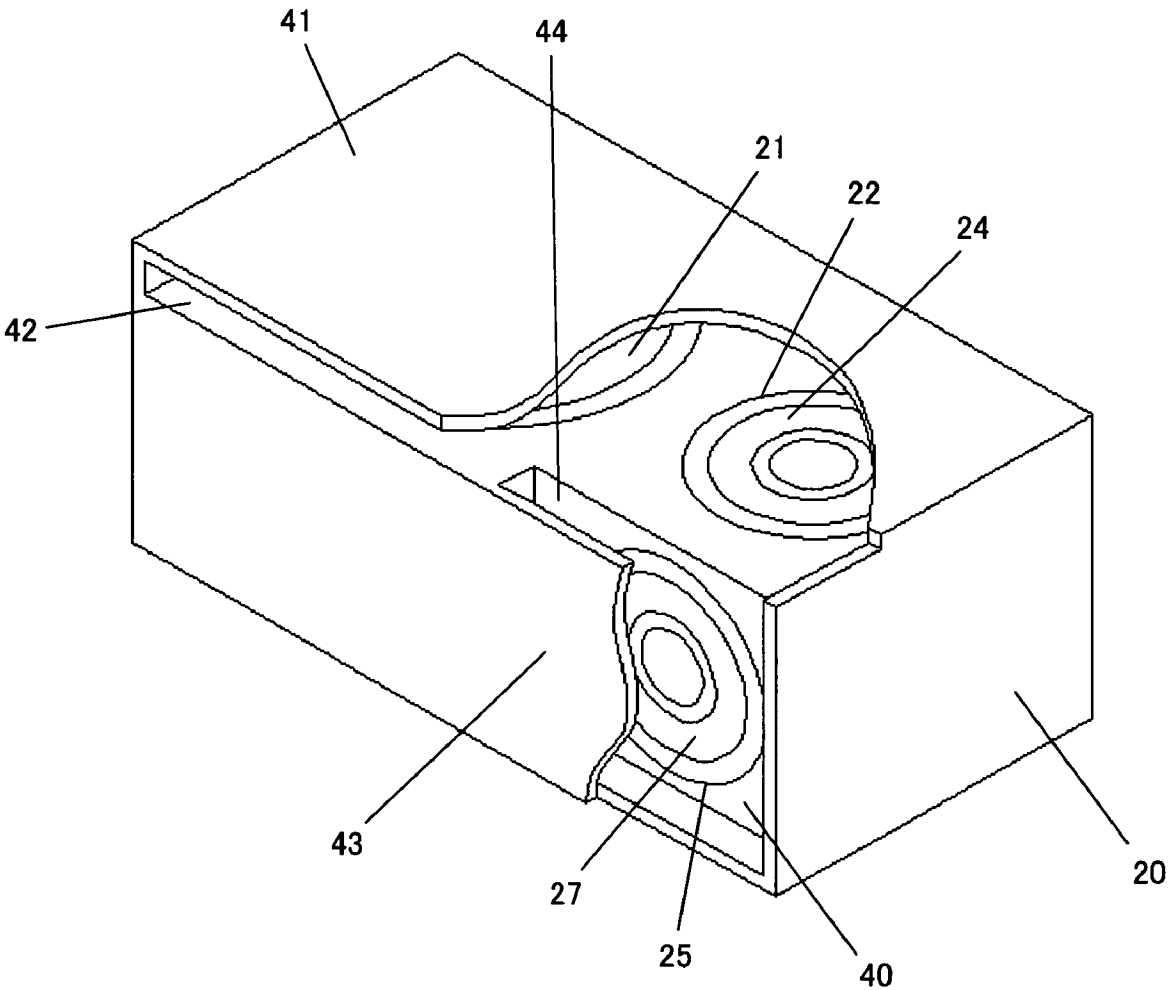
FIG. 7 is an external view of a speaker system according to Embodiment 3 of the present invention.

FIG. 7 illustrates a configuration of a speaker system according to Embodiment 3 of the present invention. FIG. 7 is an external view where a portion of the speaker system is cut away. In FIG. 7, 20 indicates a cabinet, 21 indicates a speaker unit attached to a surface of the cabinet 20, 22 indicates a first passive radiator attached to the same surface to which the speaker unit 21 is attached, 24 indicates a convex edge of the first passive radiator 22, 40 indicates a surface of the cabinet 20 perpendicular to the surface to which the first passive radiator 22 is attached, 25 indicates a second passive radiator attached to the surface 40 of the cabinet 20, 27 indicates a concave edge of the second passive radiator 25, 41 indicates a first reflector provided to cover the speaker unit 21 and the first passive radiator 22, 42 indicates an opening formed by the first reflector 41, 43 indicates a second reflector provided to cover the second passive radiator 25, and 44 indicates an opening formed by the second reflector 43. In FIG. 7, components similar to those of FIG. 1 are indicated by the same reference numerals.

An operation of the thus-configured speaker system will be described.

When a music signal is applied to the speaker unit 21, a force is generated in the voice coil, so that the cone-shaped diaphragm is vibrated to generate a sound. A sound pressure generated by the cone-shaped diaphragm is radiated into the volume of the cabinet 20, and the sound pressure causes the first passive radiator 22 and the second passive radiator 25 to vibrate to reproduce sounds.

Here, a sound radiated by the first passive radiator 22 is introduced to the opening 42 by the first reflector 41, and is radiated through the opening 42. Also, a sound radiated by the second passive radiator 25 is introduced to the opening 44 by the second reflector 43 before being radiated through the opening 42 together with the sound radiated by the first passive radiator 22. The convex edge 24 of the first passive radiator 22 is in the shape of a convex roll, and the concave edge 27 of the second passive radiator 25 is in the shape of a concave roll. Specifically, the shape of the convex edge 24 of the first passive radiator 22 and the shape of the concave edge 27 of the second passive radiator 25 are symmetrical about the attached surface of the cabinet 20. Therefore, when the sound radiated by the first passive radiator 22 and the sound radiated by the second passive radiator 25 are combined together at the opening 42, the asymmetry of the air displacements by the vibration of the passive radiators are canceled, resulting in reproduction of a low-frequency sound having a low distortion.

According to this embodiment, the first passive radiator 22 and the second passive radiator 25 can be provided on different surfaces of the cabinet 20. Therefore, even when there is a limitation on the dimensions of the cabinet 20, a speaker system capable of reproducing a low-frequency sound having a low distortion can be achieved.

Embodiment 4

Figure 8:
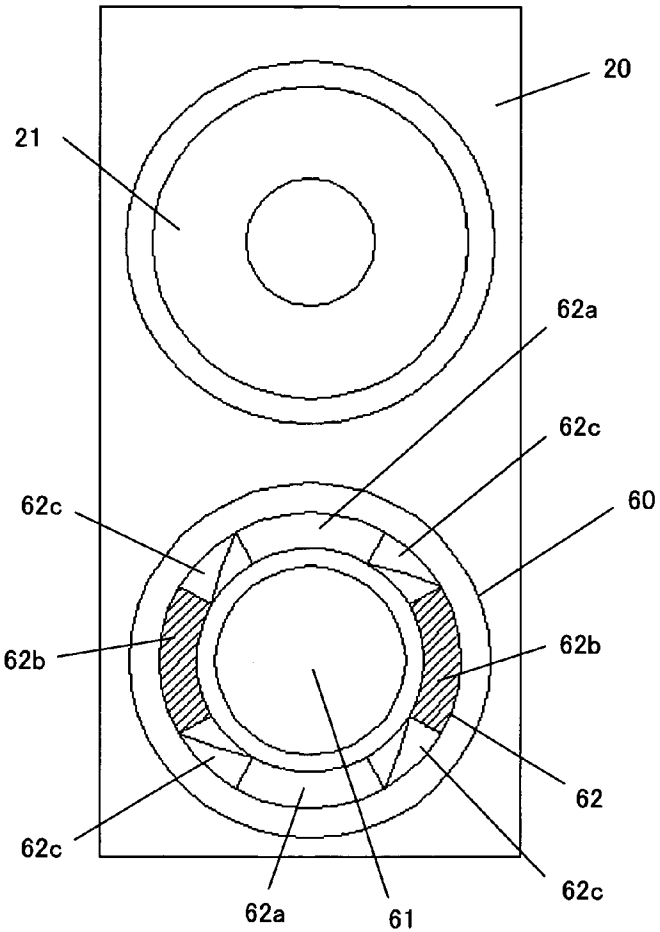
FIG. 8 is a front view of a speaker system according to Embodiment 4 of the present invention.
Figure 9:
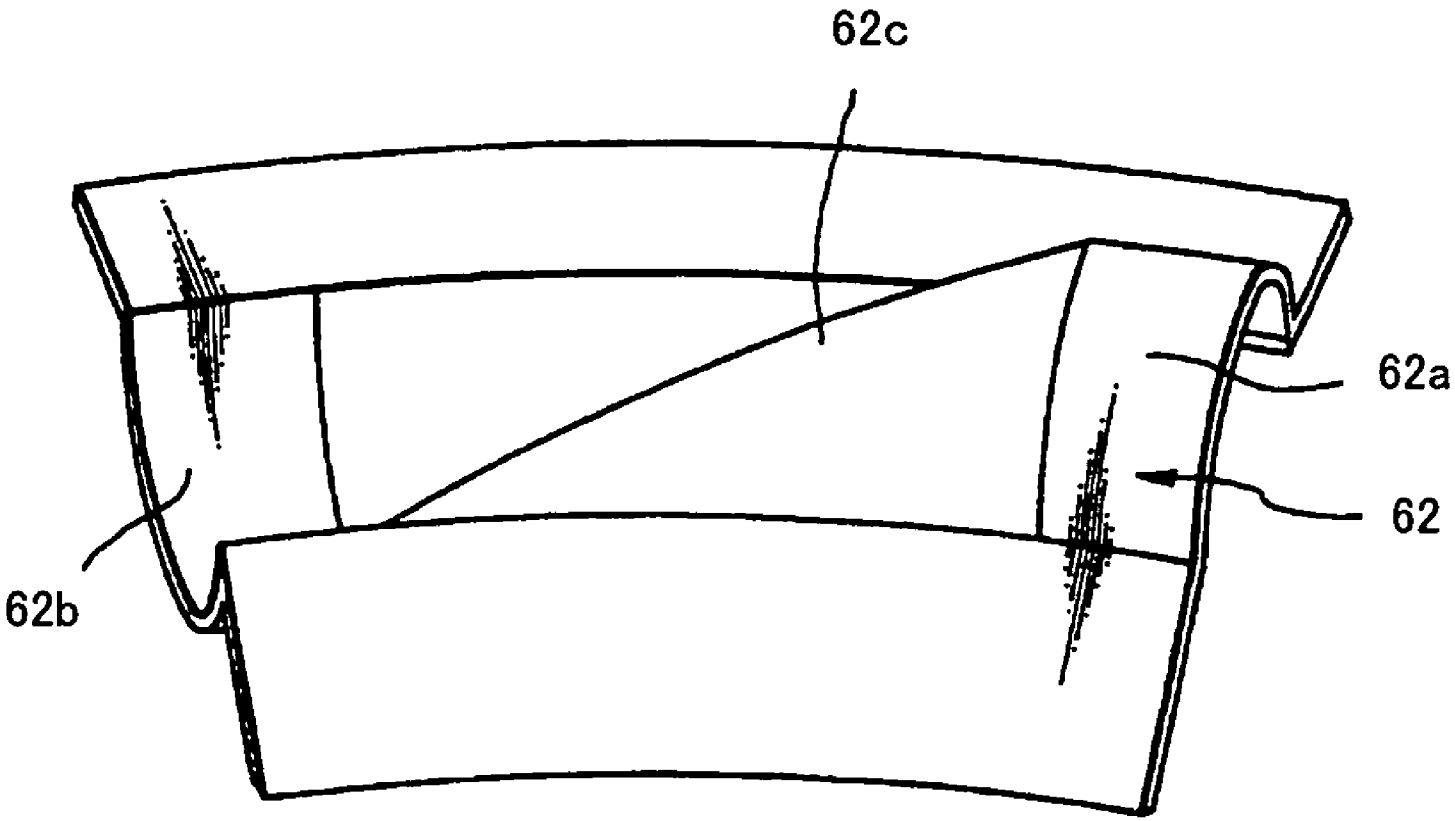
FIG. 9 is an external view illustrating an edge portion of a passive radiator according to Embodiment 4 of the present invention.

FIG. 8 illustrates a front view of a speaker system according to Embodiment 4 of the present invention. In FIG. 8, 20 indicates a cabinet, 21 indicates a speaker unit, 60 indicates a passive radiator, 61 indicates a diaphragm which is a component of the passive radiator 60, and 62 indicates an edge which is a component of the passive radiator 60. The edge 62 comprises convex roll portions 62*a*, concave roll portions 62*b*, and connection portions 62*c* which continuously connect the convex roll portions 62*a* and the concave roll portions 62*b*. FIG. 9 is a perspective view illustrating details of the connection portion 62*c*. Note that the passive radiator 60 of FIG. 8 is in the shape of, for example, a circle.

An operation of the thus-configured speaker system will be described.

When a music signal is applied to the speaker unit 21, a force is generated in the voice coil, so that the cone-shaped diaphragm is vibrated to generate a sound. A sound pressure generated by the cone-shaped diaphragm is radiated into the volume of the cabinet 20, so that the sound pressure causes the passive radiator 60 to vibrate to reproduce a sound.

Embodiment 4 is different from Embodiment 1 in that, while two passive radiators are provided in Embodiment 1, only one passive radiator is provided in Embodiment 4. The edge 62 of the passive radiator 60 is divided into a plurality of elements in a circumferential direction, and particularly, has the convex roll portions 62*a* which are convex with respect to the attached surface of the cabinet 20 and the concave roll portions 62*b* which are concave with respect to the attached surface of the cabinet 20. The convex roll portions 62*a* and the concave roll portions 62*b* are alternately provided along the circumferential direction. Therefore, when the amount of air displaced when the diaphragm 61 of the passive radiator 60 is moved forward (i.e., toward the outside of the cabinet 20) is equal to the amount of air displaced when the diaphragm 61 is moved backward (i.e., toward the inside of the cabinet 20). In other words, a distortion component included in a sound radiated from the convex roll portion 62*a* which is caused by the asymmetry of the air displacements, and a distortion component included in a sound radiated from the concave roll portion 62*b* which is caused by the asymmetry of the air displacements, are canceled with each other, so that a distortion component caused by the asymmetry of the air displacements which is radiated by the whole edge 62 is are significantly reduced.

As described above, according to this embodiment, although the shape of the edge is complicated as compared to Embodiment 1, the number of passive radiators attached to the cabinet is one, so that the configuration of the speaker system is simplified, i.e., the speaker system can be caused to be more compact.

Figure 10:
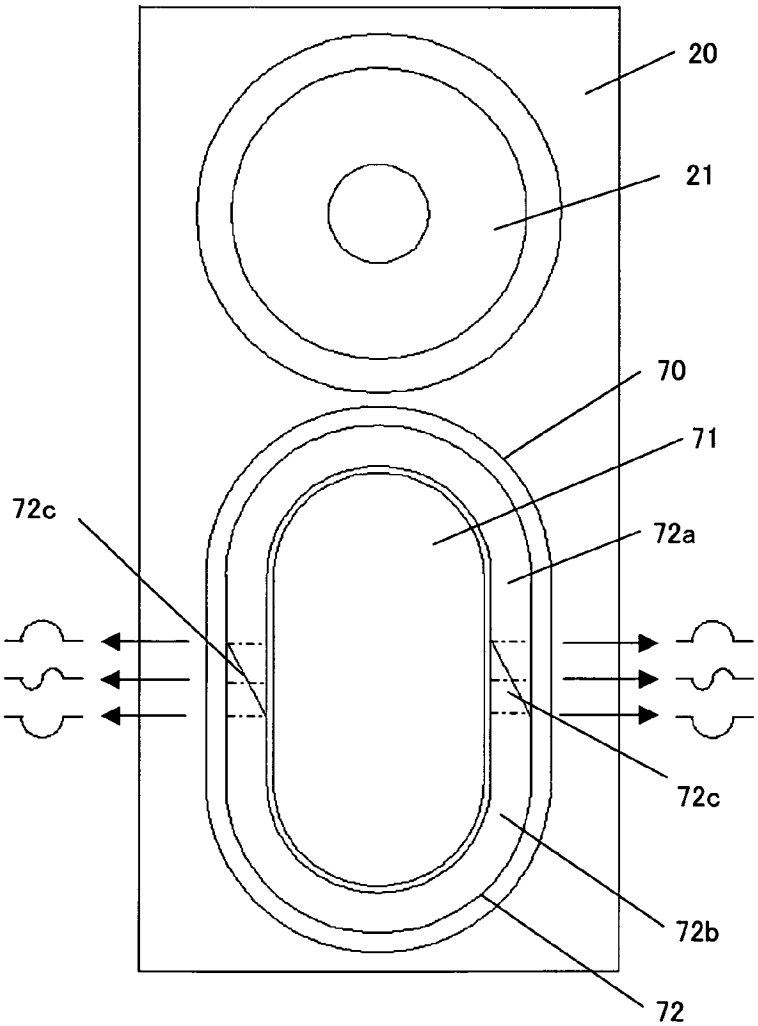
FIG. 10 is a front view of a speaker system which employs a track-shaped passive radiator.

Note that the shape of the passive radiator is not limited to the circular shape of FIG. 8. For example, as illustrated in FIG. 10, a passive radiator 70 in the shape of a track may be employed. FIG. 10 is a front view of a speaker system employing the track-shaped passive radiator 70. In FIG. 10, a diaphragm 71 is in the shape of a track. An edge 72 comprises a convex roll portion 72*a*, a concave roll portion 72*b*, and a connection portion 72*c* continuously connecting the convex roll portion 72*a* and the concave roll portion 72*b*. In the configuration of the passive radiator 70 of FIG. 10, the edge 72 has a simple configuration which is divided into two, i.e., the convex roll portion 72*a* and the concave roll portion 72*b*. Nevertheless, a distortion reducing effect similar to that of the passive radiator 60 of FIG. 8 can be obtained. The passive radiator may be in the shape of, for example, a square, a rectangle, or other polygons.

Embodiment 5

As Embodiment 5, vibration balance and weight balance of a diaphragm which enables suppression of the rolling phenomenon, will be described. The rolling phenomenon refers to a phenomenon that a diaphragm is not moved in the vibration direction and, for example, is vibrated in a direction oblique to the vibration direction. Here, the edge 72 of the passive radiator 70 described above is divided into two elements (the convex roll portion 72*a* and the concave roll portion 72*b*) in the outer circumferential direction. Also, the convex roll portion 72*a* and the concave roll portion 72*b* of the edge 72 are convex and concave with respect to the attached surface of the cabinet 20. Therefore, the convex roll portion 72*a* and the concave roll portion 72*b* have different stiffnesses values. This is one of the causes of generation of the rolling phenomenon. Therefore, in this embodiment, attention is paid to the vibration balance and the weight balance of the diaphragm 71 so as to suppress the occurrence of the rolling phenomenon. Hereinafter, the vibration balance and weight balance of the diaphragm for suppressing the occurrence of the rolling phenomenon will be described.

Figure 11:
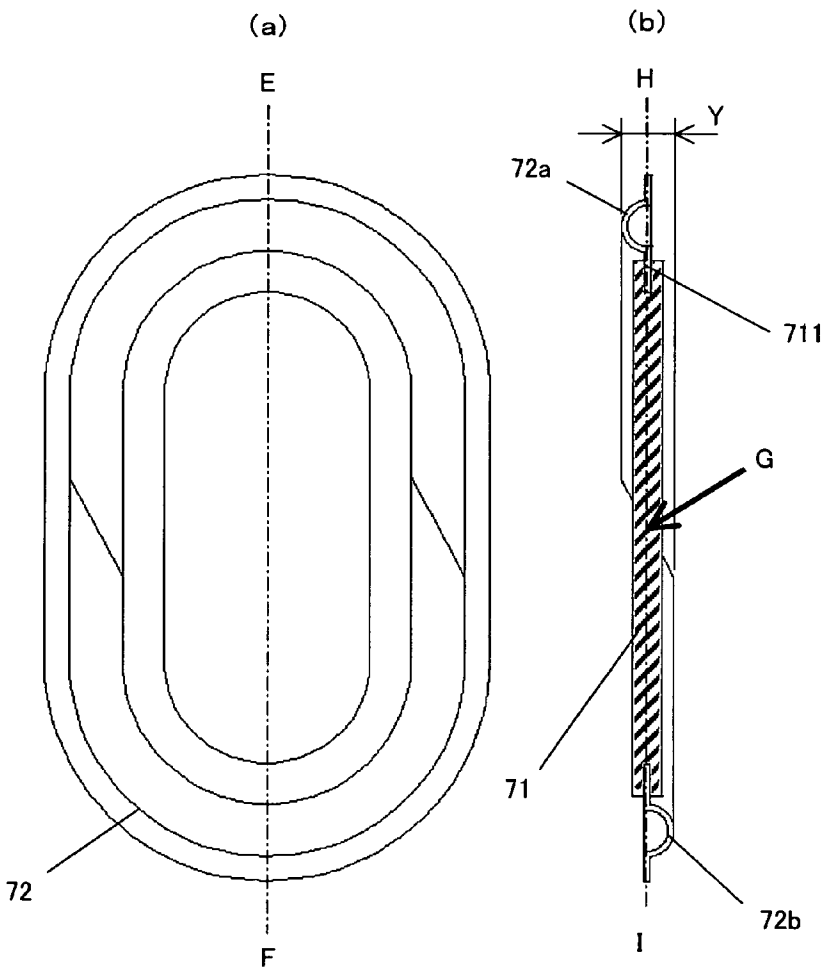
FIG. 11 is a diagram illustrating an exemplary structure for suppressing the occurrence of the rolling phenomenon in a passive radiator 70 of FIG. 10.

Firstly, the vibration balance of the diaphragm which can suppress the occurrence of the rolling phenomenon, will be described. Here, the passive radiator 70 of FIG. 10 will be discussed for the purpose of illustration. FIG. 11 is a diagram illustrating an exemplary structure for suppressing the occurrence of the rolling phenomenon in the passive radiator 70 of FIG. 10. FIG. 11(*a*) illustrates a front view of the passive radiator 70. FIG. 11(*b*) is a cross-sectional view of the passive radiator 70, taken along line E-F. In FIG. 11(*b*), a center-of-gravity position in a thickness direction of the diaphragm 71 is represented by a point G. The thickness direction of the diaphragm 71 is a lateral direction in FIG. 11(*b*) and is also a vibration direction of the diaphragm 71. A height dimension in the vibration direction of the edge 72 is indicated by Y. A center line passing through a center position of the height dimension Y is indicated by HI. As illustrated in FIG. 11(*b*), the diaphragm 71 is provided with a groove 711 formed in an outer circumferential portion thereof. An inner circumferential portion of the edge 72 is inserted into and fixed by the groove 711 to be integrated with the diaphragm 71. In other words, the passive radiator 70 of FIG. 11 has a sandwich structure in which the inner circumferential portion of the edge 72 is sandwiched by the outer circumferential portion of the diaphragm 71. Also, the edge 72 is fixed so that the center-of-gravity position G of the diaphragm 71 is positioned on the center line HI. In other words, the edge 72 is fixed so that the center-of-gravity position G of the diaphragm 71 and the center position of the height dimension Y of the edge 72 are provided at the same position in the vibration direction of the diaphragm 71.

It is here assumed that the center-of-gravity position G of the diaphragm 71 and the center position of the height dimension Y of the edge 72 are not provided at the same position. Typically, the passive radiator 70 is positioned as illustrated in FIG. 10. In this case, if the center-of-gravity position G of the diaphragm 71 is not present on the center line HI, the gravity applied to the center-of-gravity position of the diaphragm 71 acts as a force which rotates the diaphragm 71. Thereby, the rolling phenomenon is likely to occur. However, as described above, when the center-of-gravity position G of the diaphragm 71 and the center position of the height dimension Y of the edge 72 are provided at the same position, the gravity applied to the center-of-gravity position does not act as a force which rotates the diaphragm 71, and does not cause the occurrence of the rolling phenomenon. Thus, when the center-of-gravity position G of the diaphragm 71 and the center position of the height dimension Y of the edge 72 are provided at the same position, the vibration balance of the diaphragm 71 can be improved. As a result, also in the passive radiator having the convex roll portion and the concave roll portion, the occurrence of the rolling phenomenon can be suppressed. It has been assumed that the edge 72 is fixed so that the center-of-gravity position G of the diaphragm 71 is positioned on the center line HI. However, even when a manufacturing step is performed to try to fix the edge 72 so that the center-of-gravity position G of the diaphragm 71 is positioned on the center line HI, the center-of-gravity position G of the diaphragm 71 may be deviated from the center line HI. In this case, if the deviation still allows the exhibition of an effect intended by the present invention, it is assumed in the case of such a positional relationship that the center-of-gravity position G of the diaphragm 71 is positioned on the center line HI. In other words, it is difficult to completely position the center-of-gravity position G of the diaphragm 71 on the center line HI due to a variation during manufacture, and an error due to the manufacture variation can be tolerated.

Figure 21:
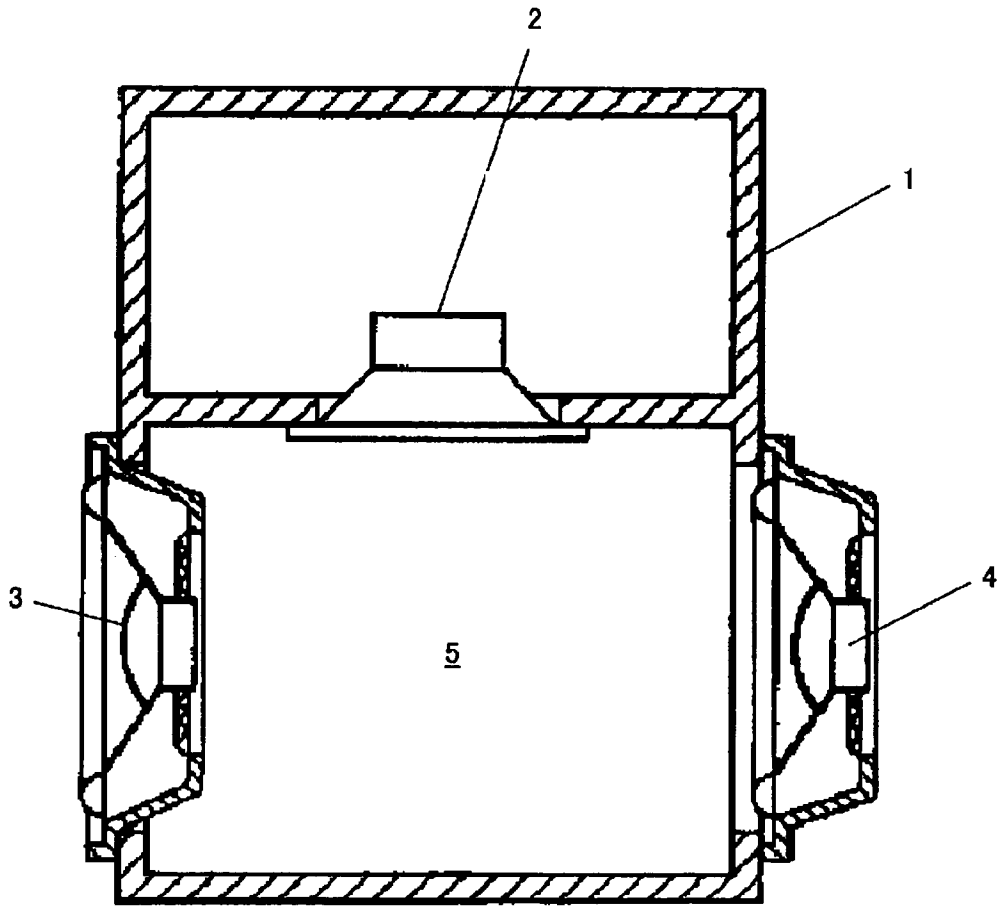
Fig. 21 PRIOR ART
FIG. 21 is a cross-sectional view illustrating a structure of a conventional speaker system.
Figure 22:
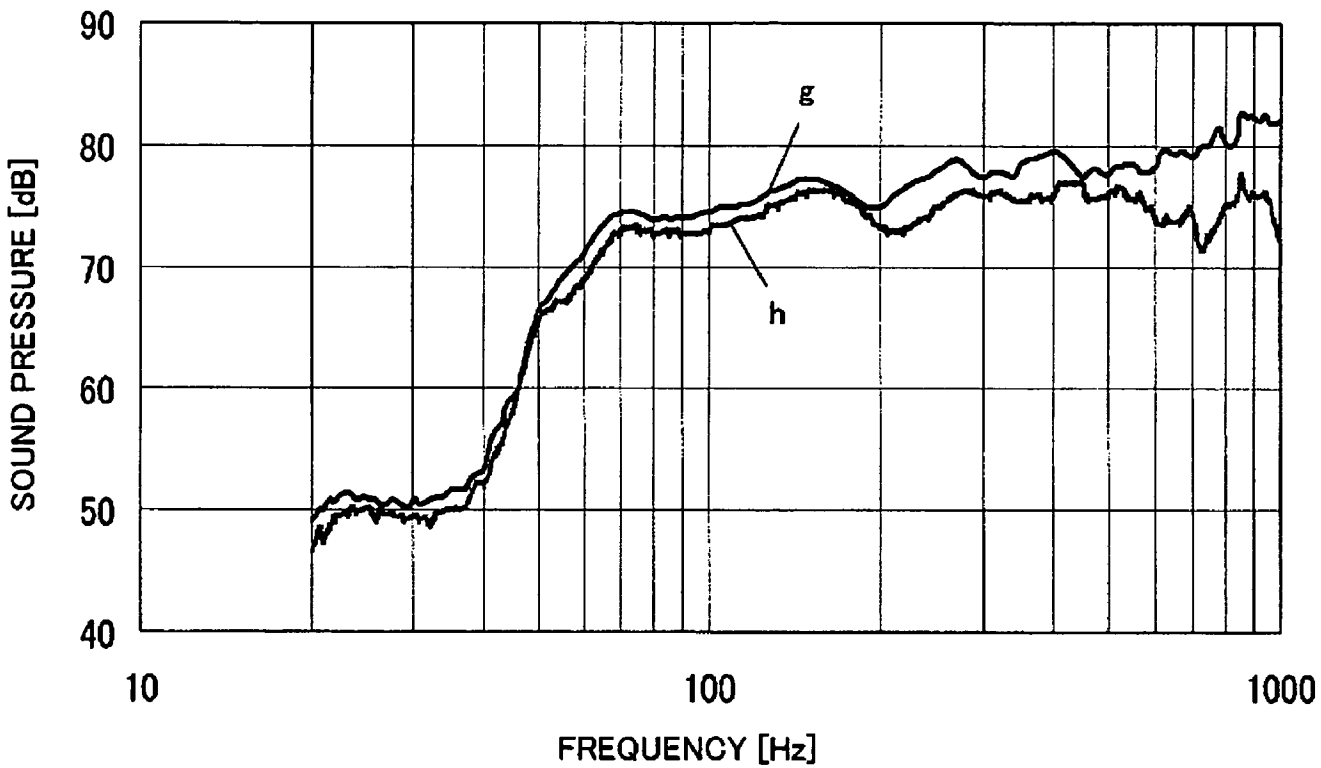
Fig. 22 PRIOR ART
FIG. 22 is a diagram illustrating sound pressure-frequency characteristics of a conventional speaker system.

Further, the conventional passive radiators 3 and 4 of FIG. 21 have a structure in which the diaphragm is supported at two points, i.e., the edge and the damper. This is because, unless the stiffnesses of both the edge and the damper are used, i.e., unless the stiffness of the supporting system supporting the diaphragm is large, it is difficult to suppress the occurrence of the rolling phenomenon. In contrast to this, the passive radiator 70 of FIG. 11 has a structure in which the occurrence of the rolling phenomenon is suppressed, so that the diaphragm 71 can be supported only by the edge 72. Therefore, as compared to the conventional passive radiators 3 and 4, the stiffness of the whole supporting system can be sufficiently reduced. As a result, the resonant frequency of the passive radiator 70 itself can be sufficiently reduced. In other words, it is possible to solve the problem that the limit of reproduction of a low-frequency sound by the speaker system is limited by the resonant frequency of the passive radiator 70 itself.

Figure 12:
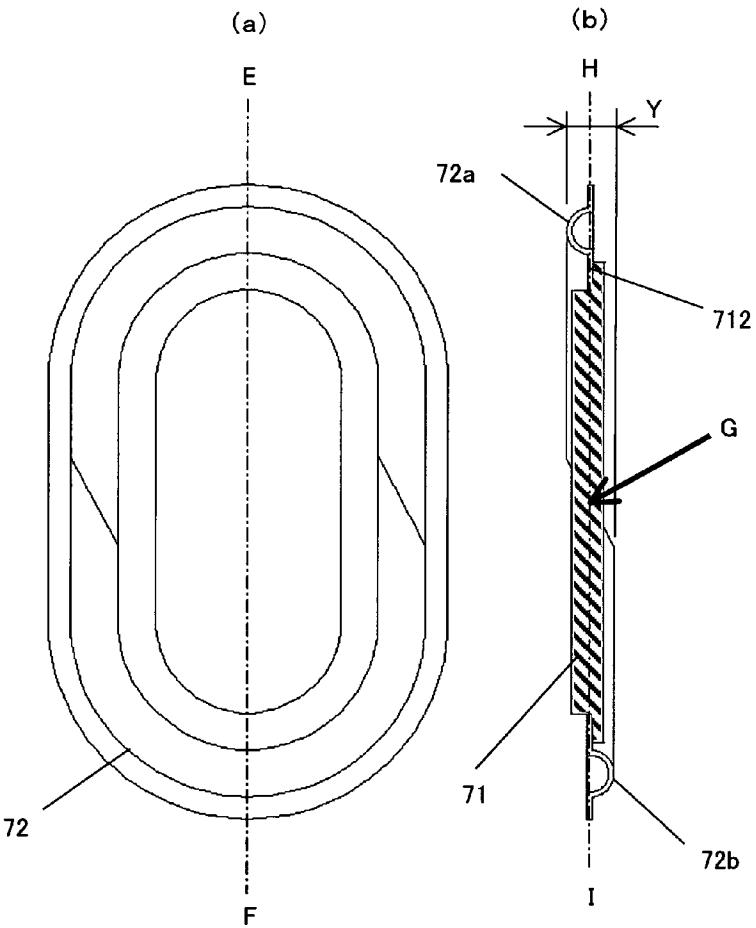
FIG. 12 is a diagram illustrating another exemplary structure of a diaphragm 71 in the passive radiator 70 of FIG. 11.

Note that the outer circumferential portion of the diaphragm 71 of FIG. 11 may have a shape as illustrated in FIG. 12, for example. FIG. 12 is a diagram illustrating another exemplary structure of the diaphragm 71 in the passive radiator 70 of FIG. 11. FIG. 12(*a*) illustrates a front view of the passive radiator 70. FIG. 12(*b*) is a cross-sectional view of the passive radiator 70, taken along line E-F. A planar portion 712 having a thickness thinner than that of a center portion is formed in the outer circumferential portion of the diaphragm 71 of FIG. 12(*b*). Also, the planar portion 712 is formed within a range in which the outer circumferential portion of the diaphragm 71 and the inner circumferential portion of the edge 72 are joined together. The inner circumferential portion of the edge 72 is fixed to the planar portion 712 having the thin thickness. Also in this case, the edge 72 is fixed so that the center-of-gravity position G of the diaphragm 71 is positioned on the center line HI. Thereby, an effect similar to that of the passive radiator 70 of FIG. 11 can be expected. Further, the passive radiator 70 of FIG. 12 has a simplified structure in which the edge 72 is adhered to the planar portion 712 of the diaphragm 71. The passive radiator 70 of FIG. 12 has a structure which can improve the productivity, but not the complicated structure of FIG. 11 in which the edge 72 is sandwiched by the diaphragm 71.

Figure 13:
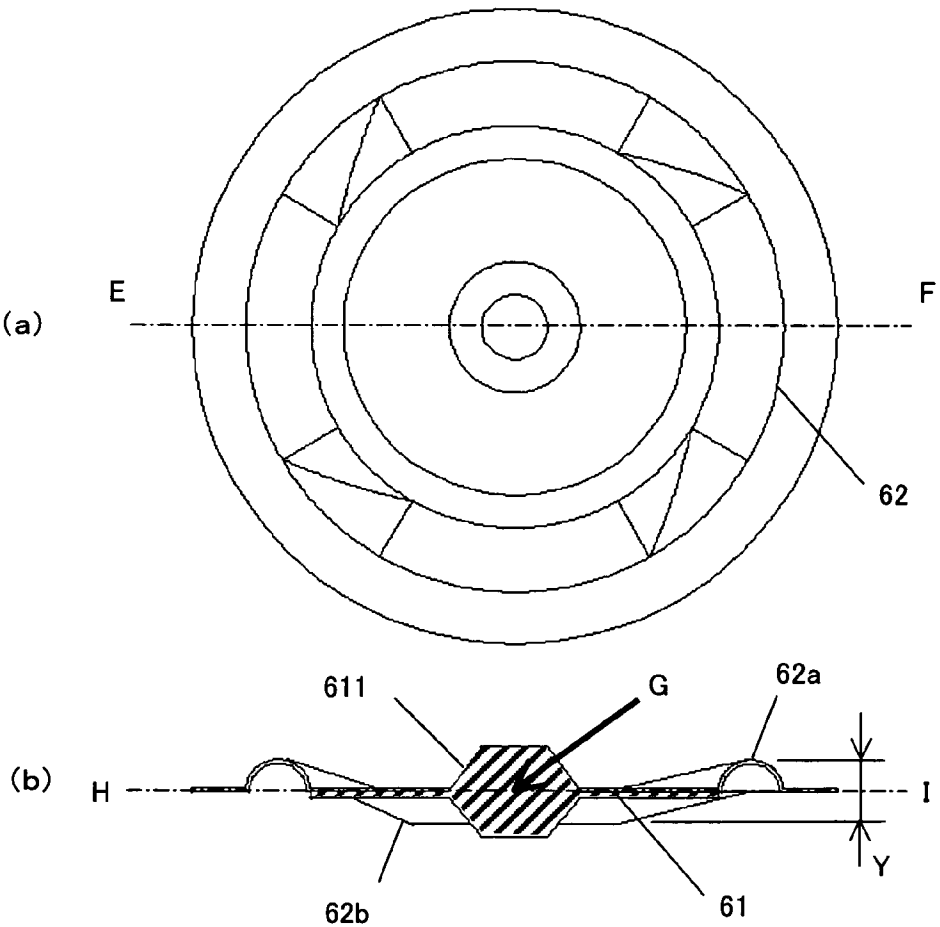
FIG. 13 is a diagram illustrating an exemplary structure of a diaphragm 61 in which a weight balance is taken into consideration in a passive radiator 60 of FIG. 8.

Next, the weight balance of the diaphragm which can suppress the occurrence of the rolling phenomenon will be described. Here, the circular passive radiator 60 of FIG. 8 will be discussed for the purpose of illustration. FIG. 13 is a diagram illustrating an exemplary structure of the diaphragm 61 in which the weight balance is taken into consideration in the passive radiator 60 of FIG. 8. FIG. 13(*a*) illustrates a front view of the passive radiator 60. FIG. 13(*b*) is a cross-sectional view of the passive radiator 60, taken along line E-F. In FIG. 13(*b*), a center-of-gravity position in a thickness direction of the diaphragm 61 is represented by a point G. Note that the thickness direction of the diaphragm 61 is a vertical direction of FIG. 13(*b*), and is also a vibration direction of the diaphragm 61. The diaphragm 61 of FIG. 13 has a structure in which a center portion thereof is thick. Specifically, in FIG.

13(*b*), the diaphragm 61 is configured so that the thickness is reduced from a center toward the outer circumference of the diaphragm. In other words, the diaphragm 61 is configured so that a mass per unit area (surface density) at the center portion of the diaphragm 61 is larger than that at the outer circumferential portion of the diaphragm 61. Note that the center portion having a thicker thickness of the diaphragm 61 is referred to as a weight portion 611. The weight portion 611 is a portion at which the material of the diaphragm 61 is thicker.

Figure 14:
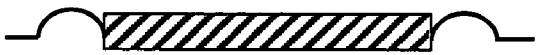
FIG. 14 is a diagram illustrating the result of a study on an influence of a weight balance of a diaphragm on the rolling phenomenon.
Figure 14:
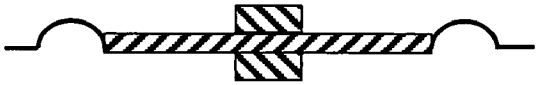
Figure 14:
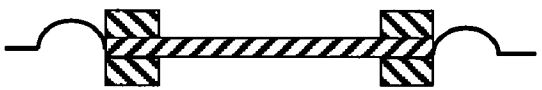

Here, the result of a study on an influence of the weight balance of the diaphragm on the rolling phenomenon is illustrated in FIG. 14. FIG. 14 illustrates resonant frequencies and rolling frequencies measured when the entire diaphragm has a uniform thickness (α), when the diaphragm has a center portion having a thicker material thickness (or the material has a larger specific gravity), i.e., having a larger weight (β), and when the outer circumferential portion has a larger weight (γ). Note that the results of FIG. 14 were obtained under the following measurement conditions: the passive radiator 60 has a diameter of 8 cm, the diaphragm has the same weight of 18 g in all of α to γ, and the same edge 62 is used in all of α to γ, i.e., the stiffness value is constant.

In FIG. 14, the resonant frequency is a frequency which is determined by the weight of the diaphragm and the stiffness of the edge. The diaphragm weights and the edge stiffnesses of α to γ have the same values, so that α to γ have the same resonant frequency of 11.8 Hz.

In FIG. 14, the rolling frequency is a frequency at which the rolling phenomenon occurs. As can be seen from the values of the rolling frequencies of α to γ, the rolling frequencies significantly varies, depending on the difference between the weight balances of the diaphragms. In general diaphragms including the conventional passive radiators 3 and 4, the material thickness of the diaphragm is uniform. In other words, the weight balance of the conventional diaphragm corresponds to the weight balance of α of FIG. 14. In contrast to this, when the weight balance of a diaphragm is assumed to be a weight balance illustrated in β, the rolling frequency is improved by a factor of 28.8 Hz/18.2 Hz=about 1.6 as compared to when the weight balance of α is used. Here, in general, the higher the frequency, the lower the amplitude amount of the diaphragm. Therefore, the higher the rolling frequency, the lower the amplitude due to the rolling phenomenon, and as a result, the more the reduction in disturbance of a reproduced sound pressure. For reference, FIG. 14 also illustrates a rolling frequency when a weight balance which increases the weight of the outer circumferential portion of a diaphragm is used (γ). In this case, the rolling frequency is reduced by a factor of about 0.8 as compared to the diaphragm having a uniform material thickness (α). Thus, as a weight balance of a diaphragm for suppressing the occurrence of the rolling phenomenon, a weight balance which increases the weight of the center portion of a diaphragm is optimal. By increasing the weight of the center portion of a diaphragm, the rolling frequency is shifted to a high frequency band having a small amplitude amount, so that the occurrence of the rolling phenomenon can be suppressed.

Note that, in FIG. 13, the center-of-gravity position G of the diaphragm 61 may or may not be the same as the center position of the height dimension Y of the edge 62 in the vibration direction of the diaphragm 61. When the center-of-gravity position G of the diaphragm 61 is the same as the center position of the height dimension Y of the edge 62, the vibration balance is improved as described above, so that the occurrence of the rolling phenomenon can be further suppressed. Also, even when the center-of-gravity position G of the diaphragm 61 is not the same as the center position of the height dimension Y of the edge 62, the occurrence of the rolling phenomenon can be suppressed by the above-described weight balance.

Figure 15:
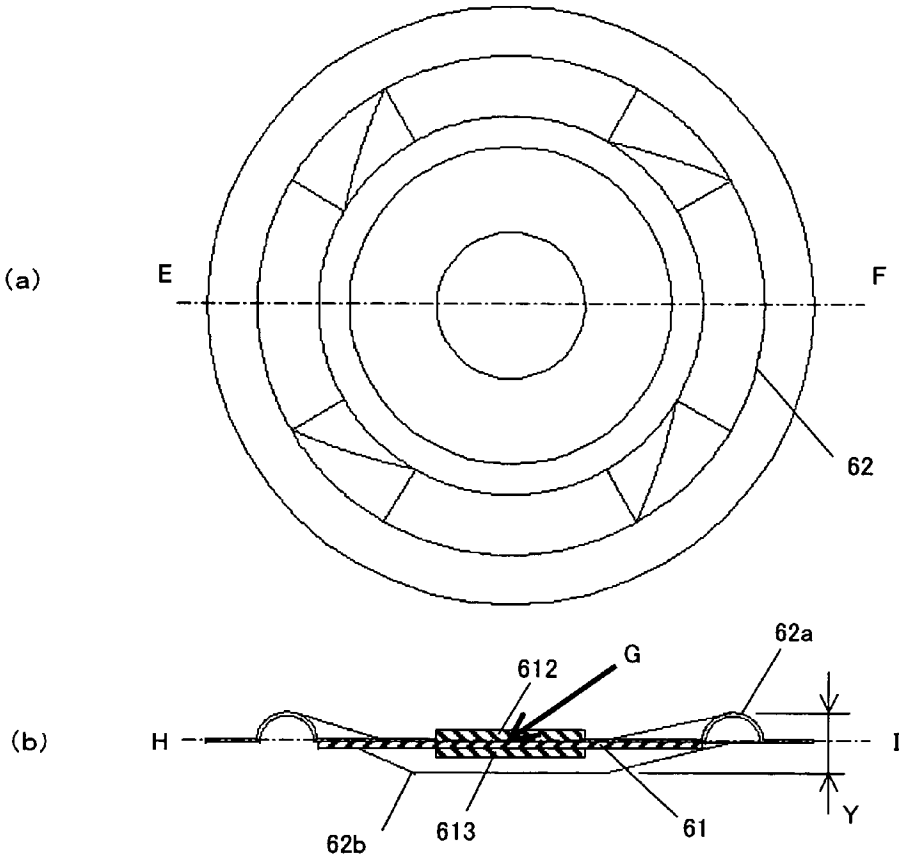
FIG. 15 is a diagram illustrating another exemplary structure of a diaphragm 61 having a weight balance which increases the weight of a center portion thereof.

Also, as a structure of a diaphragm which has a weight balance which increases the weight of the center portion, a diaphragm structure illustrated in FIG. 15 may be employed. FIG. 15 is a diagram illustrating another exemplary structure of the diaphragm 61 having a weight balance which increases the weight of the center portion. FIG. 15(*a*) illustrates a front view of the passive radiator 60. FIG. 15(*b*) is a cross-sectional view of the passive radiator 60, taken along line E-F. In FIG. 15(*b*), a center-of-gravity position in a thickness direction when weights 612 and 613 described below are integrated with the diaphragm 61 is represented by a point G. Note that the thickness direction is a vertical direction in FIG. 15(*b*), and is also a vibration direction of the diaphragm 61. The diaphragm 61 of FIG. 15 is a planar diaphragm made of a resin material, such as, for example, ABS or the like. The diaphragm 61 of FIG. 15 is provided with the circular weights 612 and 613 on opposite surfaces of the center portion. Specifically, the weights 612 and 613 are in the shape of a circle having a diameter smaller than that of the diaphragm 61, and are fixed so as to have the same center as that of the diaphragm 61. Also, the weights 612 and 613 are made of a material having a specific gravity larger than that of the diaphragm 61 made of, for example, brass, iron or the like. Thus, by adhering a weight made of a material having a specific gravity larger than that of the diaphragm 61 to the center portion of the diaphragm 61, the thickness of the center portion of the diaphragm 61 can be caused to be smaller than that of the diaphragm 61 of FIG. 13. Also, as illustrated in FIG. 13, in a diaphragm in which the material thickness is changed to increase the weight of the center portion, when the weight of the weight portion 611 in the center portion is desired to be newly changed, a mold needs to be changed, for example. Specifically, once the diaphragm 61 is shaped, it is considerably difficult to subsequently change the weight of the center portion of the weight portion 611. In contrast to this, in the structure of FIG. 15, it is sufficient to change the weights of the weights 612 and 613 separately. Thus, according to the structure of FIG. 15, it is possible to achieve a passive radiator which can be easily designed and can more practically suppress the occurrence of the rolling phenomenon. Here, when the thicknesses of the weights 612 and 613 are adjusted so that the center-of-gravity position G in the thickness direction when the diaphragm 61 and the weights 612 and 613 are integrated together is positioned on the center line HI, the above-described vibration balance is also improved, thereby making it possible to further suppress the occurrence of the rolling phenomenon.

Note that even a structure in which one of the weights 612 and 613 of FIG. 15 is not adhered to the diaphragm 61 has the effect of suppressing the rolling phenomenon to some extent. In other words, even if the center-of-gravity position G when the diaphragm 61 and the weight 612 or 613 are integrated together is not the same as the center position of the height dimension Y of the edge 62, the occurrence of the rolling phenomenon can be suppressed by the above-described weight balance.

Figure 16:
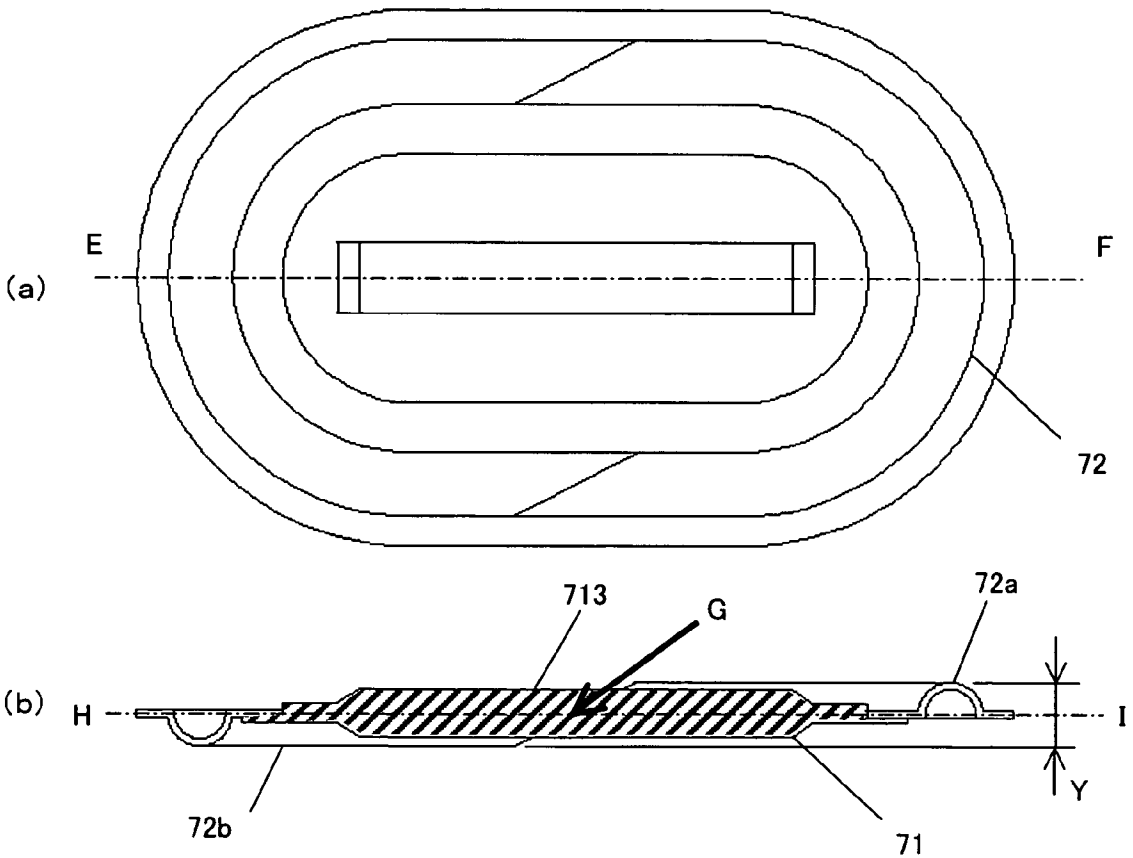
FIG. 16 is a diagram illustrating an exemplary structure of a diaphragm 71 having a weight balance which increases the weight of a center portion thereof.

Also, in the above-described track-shaped passive radiator 70, an exemplary structure of a diaphragm having a weight balance which increases the weight of the center portion is illustrated in FIG. 16. FIG. 16 is a diagram illustrating an exemplary structure of a diaphragm 71 having a weight balance which increases the weight of the center portion. FIG. 16(*a*) is a front view of the passive radiator 70. FIG. 16(*b*) is a cross-sectional view of the passive radiator 70, taken along line E-F. In FIG. 16(*b*), a center-of-gravity position in a thickness direction of the diaphragm 71 is represented by a point G. Note that the thickness direction of the diaphragm 71 is a vertical direction of FIG. 16(*b*), and is also a vibration direction of the diaphragm 71. The track-shaped diaphragm 71 of FIG. 16 has a structure in which the center portion has a material thickness which is thicker in a longitudinal direction of the track shape (the same direction as that of the center line HI). In other words, the diaphragm 71 is configured so that the thickness is reduced from the center line HI having the longitudinal direction toward two sides of the diaphragm. Note that a portion having a thick material thickness of the diaphragm 71 is referred to as a weight portion 713. In FIG. 16, the rectangular weight portion 713 is elongated and formed on the diaphragm 71 with the longer side extending in the same direction as the longitudinal direction of the track shape.

Here, when a passive radiator is in the shape of a track, the diaphragm has different vibration modes between in the longitudinal direction and in the widthwise direction. Therefore, the level of the occurrence of the rolling phenomenon differs between in the longitudinal direction and in the widthwise direction of the diaphragm. Specifically, the occurrence level is smaller in the longitudinal direction than in the widthwise direction. This is because, of the roll portions (the convex roll portion 72*a* and the concave roll portion 72*b*) of the edge 72 supporting the diaphragm 71, a roll portion which extends in the longitudinal direction has a larger share than that of a roll portion which extends in the widthwise direction. Therefore, when a passive radiator is in the shape of a track, the rolling phenomenon in the widthwise direction particularly raises a problem.

However, the weight portion 713 of FIG. 16 is formed and elongated in the longitudinal direction of the diaphragm 71. In other words, the weight portion 713 plays a role in concentrating a weight balance in the widthwise direction of the diaphragm 71 to the center portion. Thereby, the rolling frequency in the widthwise direction can be increased, thereby making it possible to suppress the occurrence of the rolling phenomenon.

Although the weight balance in the widthwise direction of the diaphragm 71 is adjusted by the weight portion 713 having an increased thickness of the diaphragm 71 in FIG. 16, a weight made of a material having a specific gravity larger than that of the diaphragm may be adhered to the center portion of the diaphragm as illustrated in FIG. 15. In this case, an effect similar to that of the passive radiator 60 of FIG. 15 is obtained.

Also, in the passive radiator 70 of FIG. 16, the center-of-gravity position G of the diaphragm 71 may not be the same as the center position of the height dimension Y of the edge 72 in the vibration direction of the diaphragm 71. In this case, the occurrence of the rolling phenomenon can be suppressed by the above-described weight balance.

Note that the passive radiator and the diaphragm of this embodiment may be in the shape of, for example, a square, a rectangle, or other polygons. Here, for example, when the diaphragm is in the shape of a square, the weights 612 and 613 are in the shape of, for example, a square which is smaller than the outer shape of the diaphragm. The weights 612 and 613 are arranged with one side being opposed to one side of the diaphragm, and the center being placed at the same position where the center of the diaphragm is placed. When the weight portion 611 is formed in the square-shaped diaphragm 61, the diaphragm 61 is configured so that the thickness is reduced from the center of the diaphragm 61 toward the outer side. When the diaphragm is in the shape of a rectangle, the weights 612 and 613 are in the shape of, for example, a rectangle which is smaller than the outer shape of the diaphragm. In this case, the weights 612 and 613 are placed with the center line in the longer side direction coinciding with that of the diaphragm. Also, when the weight portion 611 is formed in the rectangular diaphragm 61, the diaphragm 61 is configured so that the thickness is reduced from the center line in the longer side direction of the diaphragm 61 toward two longer sides of the diaphragm. When the diaphragm is in the shape of a track, the weights 612 and 613 are in the shape of, for example, a rectangle which is smaller than the outer shape of the diaphragm. In this case, the weights 612 and 613 are placed with the center line in the longer side direction coinciding with the center line (line EF in FIG. 16) of the longitudinal direction of the diaphragm.

Also, this embodiment can be applied to the first and second passive radiators 22 and 25 of Embodiments 1 to 3 described above. Note that, as described above, the shapes of the first and second passive radiators 22 and 25 need to be designed so that the amount of air displaced to the outside of the cabinet 20 is equal to the amount of air displaced to the inside.

Embodiment 6

Figure 17:
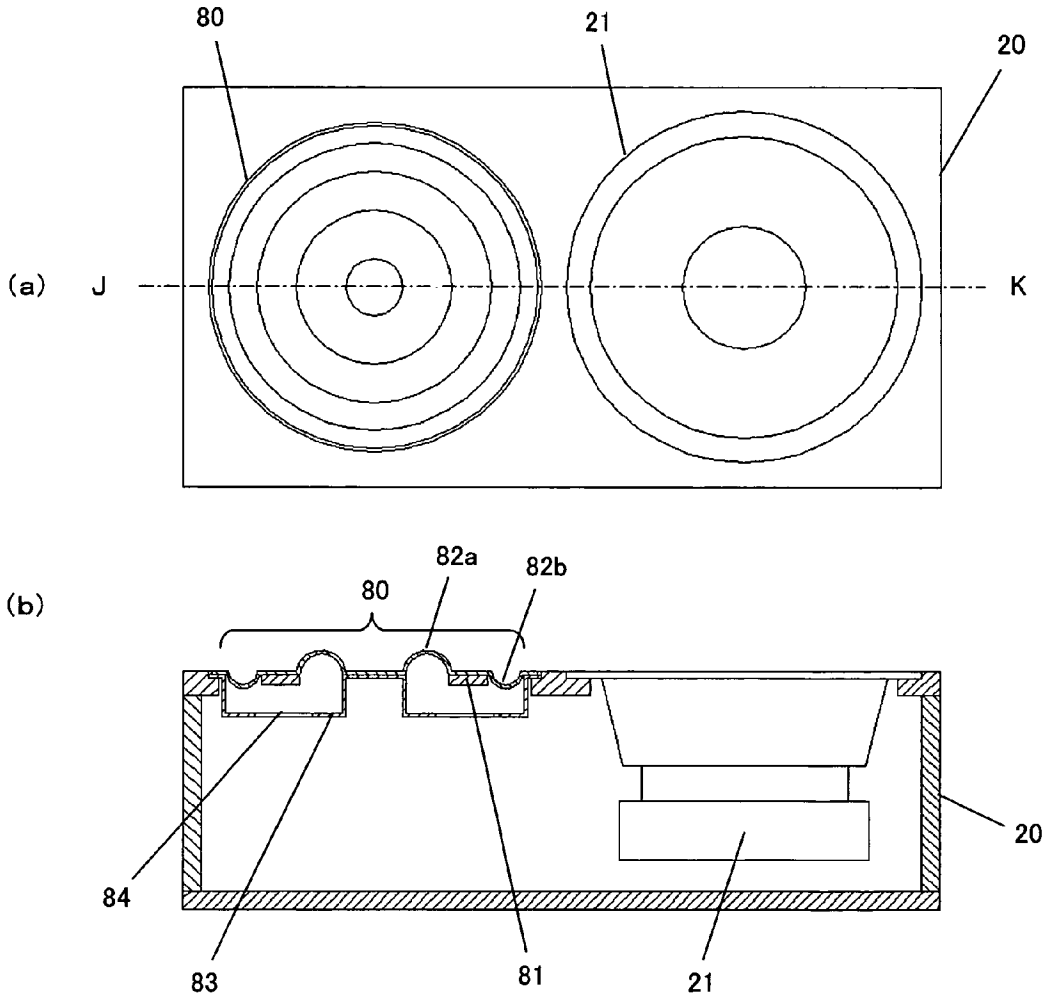
FIG. 17 is a front view of a speaker system according to Embodiment 6 of the present invention.

FIG. 17 illustrates a configuration of a speaker system according to Embodiment 6 of the present invention. Particularly, FIG. 17(*a*) is a front view of the speaker system, and FIG. 17(*b*) is a cross-sectional view of the speaker system, taken along line J-K. In FIG. 17, 20 indicates a cabinet, 21 indicates a speaker unit, 80 indicates a passive radiator, 81 indicates a ring-shaped diaphragm which is a component of the passive radiator 80, 82*a* indicates an inner edge which is an component of the passive radiator 80 and supports an inner circumference of the ring-shaped diaphragm 81, 82*b* indicates an outer edge which is an component of the passive radiator 80 and supports an outer circumference of the ring-shaped diaphragm 81, 83 indicates a frame which supports the inner edge 82*a*, and 84 indicates an air hole which is provided in the frame 83 so as to efficiently transfer the vibration of the speaker unit 21 to the ring-shaped diaphragm 81 via the air inside the cabinet 20.

In this embodiment, a configuration is adopted in which the ring-shaped diaphragm 81 is supported by the inner edge 82*a* and the outer edge 82*b*. As illustrated in FIG. 17, the inner edge 82*a* is in the shape of a roll which is convex with respect to the attached surface of the cabinet 20, and the outer edge 82*b* is in the shape of a roll which is concave with respect to the attached surface of the cabinet 20.

Note that, in the example of FIG. 17, the inner edge 82*a* has a width in a radial direction larger than that of the outer edge 82*b*. This is because a difference between the amount of air displaced by the inner edge 82*a* when the ring-shaped diaphragm 81 is moved forward due to vibration and the amount of air displaced by the inner edge 82*a* when the ring-shaped diaphragm 81 is moved backward, is equal to a difference the amount of air displaced by the outer edge 82*b* when the ring-shaped diaphragm 81 is moved backward and the amount of air displaced by the outer edge 82*b* when the ring-shaped diaphragm 81 is moved forward. The amount of air displaced by an edge depends on the magnitude of the circumference of a circle of the edge. Therefore, the width in the radial direction of the inner edge 82*a* having a relatively small circumference needs to be larger than that of the outer edge 82*b* having a relatively large circumference.

With the configuration above, the sum of the amounts of air displaced by the inner edge 82*a* and the outer edge 82*b* when the ring-shaped diaphragm 81 is moved forward due to vibration, is equal to the sum of the amounts of air displaced by the inner edge 82*a* and the outer edge 82*b* when the ring-shaped diaphragm 81 is moved backward. Therefore, distortions in sounds radiated from the inner edge 82*a* and the outer edge 82*b* are canceled with each other.

Although the shape of the inner edge 82*a* is convex and the shape of the outer edge 82*b* is concave in this embodiment, the present invention is not limited to this. The shape of the inner edge 82*a* may be concave, and the shape of the outer edge 82*b* may be convex. In this case, a similar effect is obtained.

According to this embodiment, as compared to Embodiment 1, the number of passive radiators attached to the cabinet may be one, so that the configuration of the speaker system is simplified, i.e., the speaker system can be caused to be more compact. Also, an edge which has a complicated shape as in Embodiment 4 is not required.

Embodiment 7

Figure 18:
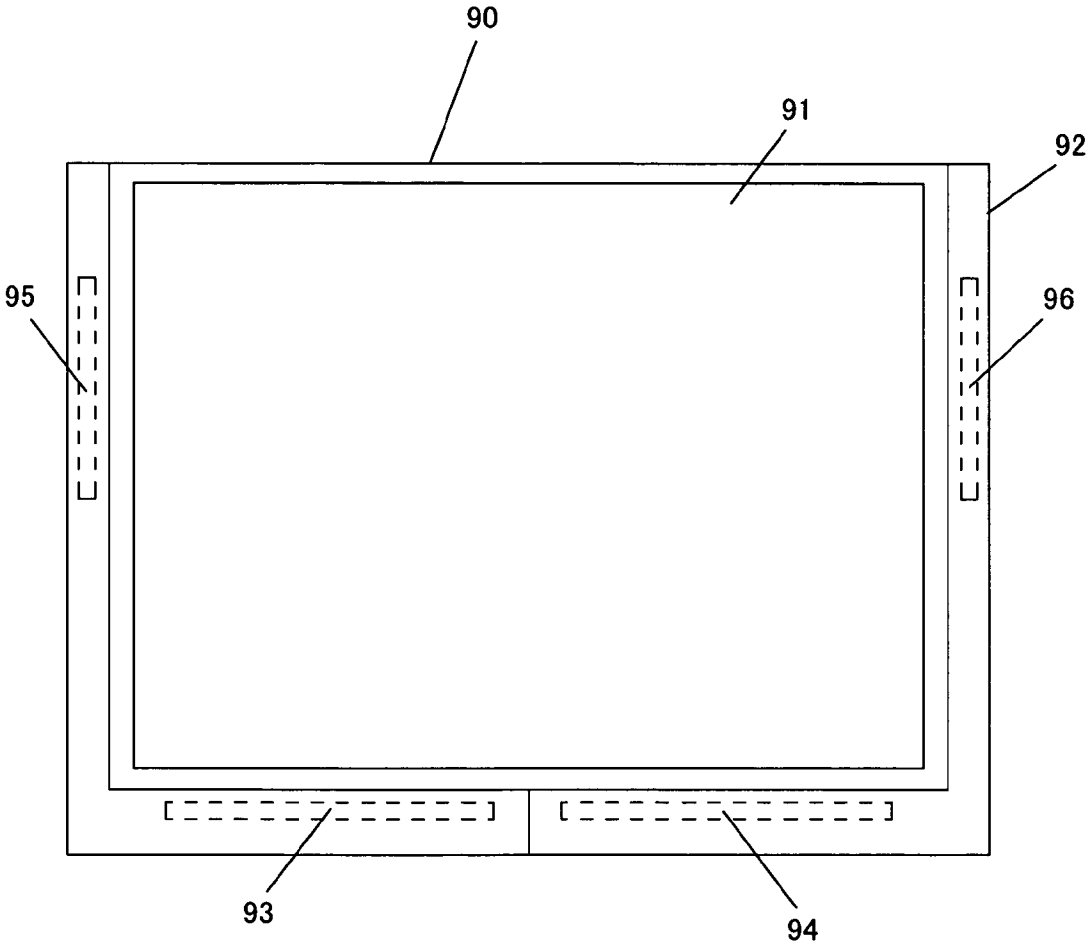
FIG. 18 is a front view of a video audio apparatus according to Embodiment 6 of the present invention.

FIG. 18 illustrates a front view of a PDP (Plasma Display Panel) as a video audio apparatus according to Embodiment 7 of the present invention. Note that the PDP is only described as an exemplary video audio apparatus of the present invention, and any other video audio apparatuses, such as liquid crystal televisions, car navigation apparatuses, and the like, are included in the video audio apparatus of the present invention. In FIG. 18, 90 indicates a main body of the PDP, 91 indicates a screen portion of the PDP main body 90, and 92 indicates a housing for the PDP main body 90. The housing 92 is provided with openings 93 and 94. The housing 92 also includes speakers 95 and 96 for high-frequency range. Note that the PDP is provided with a signal processing circuit for reproducing an image, a signal processing circuit for reproducing a sound, and the like, which will not be described herein.

An operation of the thus-configured video audio apparatus will be described.

In the housing 92, two speaker systems of Embodiment 2 (FIG. 6) or Embodiment 3 (FIG. 7) are provided for a right channel and a left channel. An opening (the opening 31 of FIG. 6 or the opening 42 of FIG. 7) provided in the speaker system for the left channel corresponds to the opening 93 of FIG. 18, while an opening provided in the speaker system for the right channel corresponds to the opening 94 of FIG. 18.

A high-frequency sound ranges for the left channel are reproduced by the high-frequency sound speaker 95, and a low-frequency sound range for the left channel is radiated from the opening 93. Therefore, sounds are reproduced from the low-frequency sound range to the high-frequency sound range for the left channel. The same is true of the right channel.

According to this embodiment, it is possible to achieve a video audio apparatus with built-in speakers which can radiate a low-frequency sound having a low distortion in a forward direction of the video audio apparatus (a direction on a side on which the screen is provided).

Figure 19:
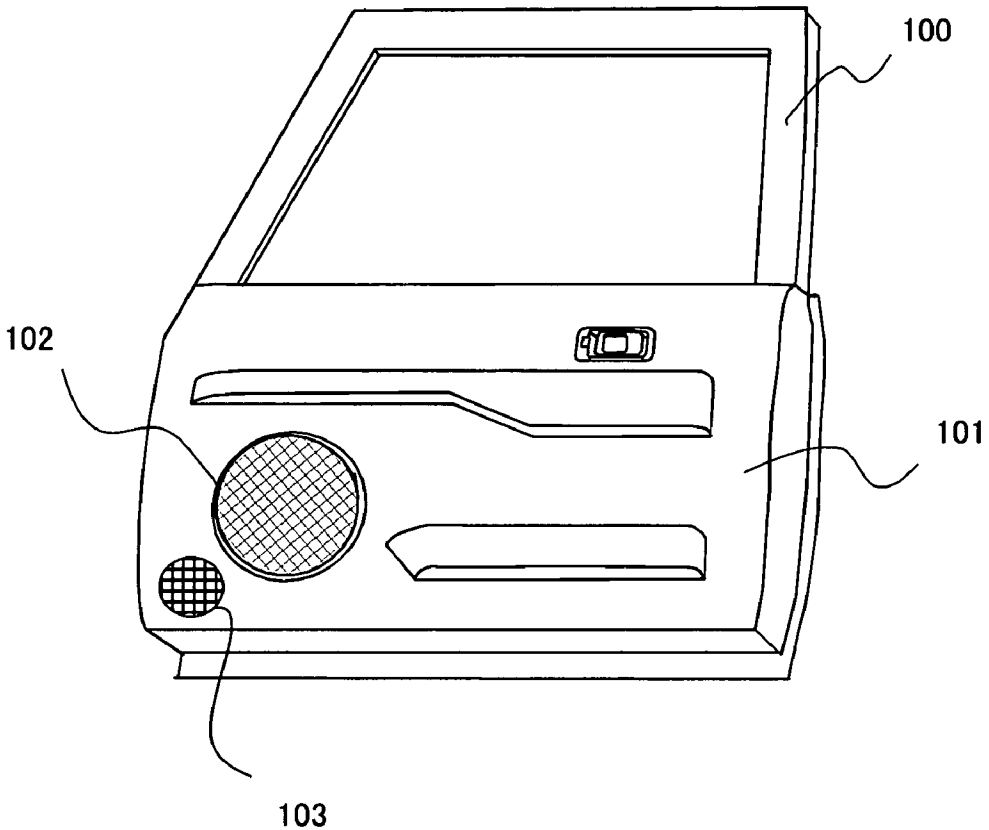
FIG. 19 is a diagram illustrating an example in which the speaker system of the present invention is provided in a door of a car.

Also, the speaker systems of Embodiments 1 to 6 described above may be a speaker system which is provided inside a body of a car. Firstly, the speaker system of Embodiments 1 to 6 described above when held in the car body will be described with reference to FIG. 19. As an example in which the speaker system is held in the car body, a door of a car is contemplated, for example. FIG. 19 is a diagram illustrating an example in which the speaker system of the present invention is provided in a door of a car.

In FIG. 19, the car door comprises a window portion 100, a door main body 101, a speaker unit 102, and a passive radiator 103. Here, the speaker unit 102 is similar to the speaker unit 21 of Embodiments 1 to 6 described above. Also, the passive radiator 103 is similar to the passive radiator 60 or 70 above. The speaker unit 102 and the passive radiator 103 are attached to the door main body 101. A space is formed inside the door main body 101. Thus, the door main body 101 plays a role as a cabinet, so that the speaker unit 102, the door main body 101, and the passive radiator 103 constitute the speaker system of the present invention. Thus, by providing the speaker system of the present invention in a door of a car, an in-car listening environment can be provided in which a distortion occurring from the edge of a passive radiator is reduced.

Figure 20:
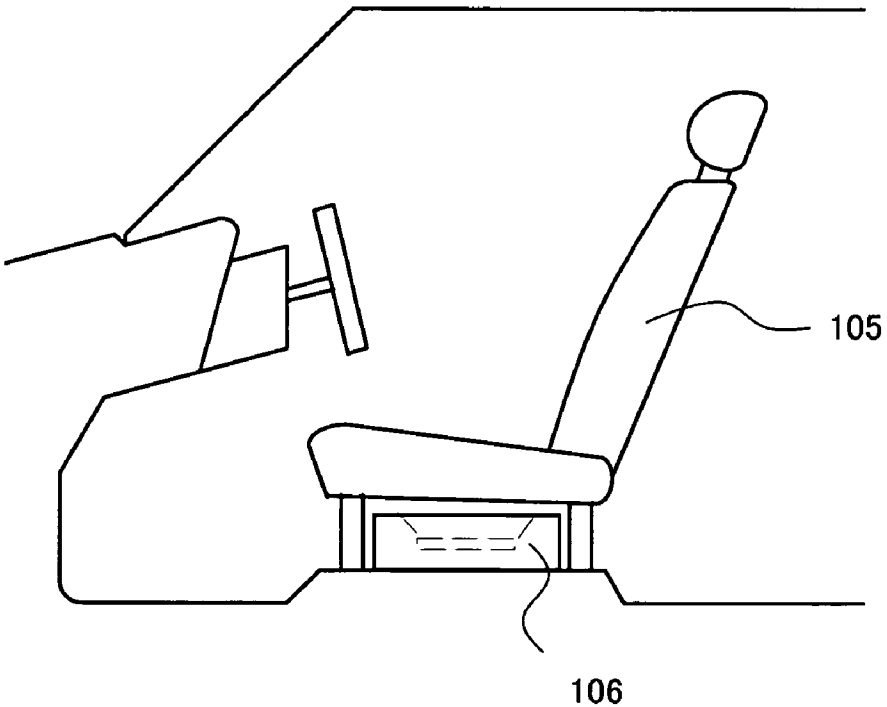
FIG. 20 is a diagram illustrating an exemplary speaker system provided in a car.

Also, the speaker systems of Embodiments 1 to 6 above may be an in-car speaker system which is provided in a car body, for example. FIG. 20 is a diagram illustrating an exemplary speaker system provided inside a car. In FIG. 20, a speaker system 106 is provided under a seat 105, for example. Here, the speaker system 106 is any of the speaker systems of Embodiments 1 to 6 described above, and will not be described in detail. Thus, by providing the speaker system 106 in a car, an in-car listening environment can be provided in which a distortion occurring from the edge of a passive radiator is reduced.

INDUSTRIAL APPLICABILITY

The speaker system of the present invention, which has a low distortion in a low-frequency sound range, is preferably used as a speaker system for audio apparatuses, such as stereo apparatuses, radio and cassette apparatuses, and the like. Also, the speaker system of the present invention is preferably used for video audio apparatuses comprising an image display function, such as liquid crystal televisions, PDPs (plasma displays), car navigation apparatuses, and the like.

The invention claimed is:

1. A speaker system comprising:

a cabinet;

at least one speaker unit attached to the cabinet; and a passive radiator attached to the cabinet, the passive radiator including a diaphragm and a supporting system supporting the diaphragm in a manner which allows the diaphragm to vibrate, wherein a part of a cross-sectional shape of the supporting system of the passive radiator and another part of a cross-sectional shape of the supporting system of the passive radiator are shaped to be substantially symmetrical to each other about a surface to which the supporting system of the passive radiator is attached so that the supporting system is configured to cancel a distortion component of a sound pressure radiated from a portion of the supporting system of the passive radiator with a distortion component of a sound pressure radiated from another portion of the supporting system of the passive radiator.

2. The speaker system according to claim 1, wherein the supporting system of the passive radiator includes an edge that is divided into a plurality of edge pieces along an outer circumference direction, and wherein the plurality of edge pieces include two edge pieces having a cross-sectional shape substantially symmetrical about the surface to which the passive radiator is attached.

3. The speaker system according to claim 2, wherein a center-of-gravity position of the diaphragm in a vibration direction of the diaphragm coincides with a center position of a height dimension of the edge in the vibration direction of the diaphragm.

4. The speaker system according to claim 2, wherein the passive radiator has a structure in which an inner circumferential portion of the edge is joined with an outer circumferential portion of the diaphragm to be fixed, and wherein the diaphragm has a structure in which a portion thereof joined with the inner circumferential portion of the edge has a thickness thinner than that of a center portion of the diaphragm.

5. The speaker system according to claim 2, wherein the passive radiator has a structure in which the inner circumferential portion of the edge is sandwiched by the outer circumferential portion of the diaphragm to be fixed.

6. The speaker system according to claim 2, wherein a center portion of the diaphragm has a mass per unit area larger than that of an outer circumferential portion of the diaphragm.

7. The speaker system according to claim 6, wherein a center-of-gravity position of the diaphragm in a vibration direction of the diaphragm coincides with a center position of a height dimension of the edge in the vibration direction of the diaphragm.

8. The speaker system according to claim 6, wherein the center portion of the diaphragm has a thickness thicker than that of the outer circumferential portion of the diaphragm.

9. The speaker system according to claim 8, wherein the diaphragm is in the shape of a circle, and wherein the diaphragm has a thickness which is reduced from a center point of the diaphragm toward an outer circumference of the diaphragm.

10. The speaker system according to claim 8, wherein the diaphragm is in the shape of a square, and wherein the diaphragm has a thickness which is reduced from a center point of the diaphragm toward an outer side of the diaphragm.

11. The speaker system according to claim 8, wherein the diaphragm is in the shape of a rectangle, and wherein the diaphragm has a thickness which is reduced from a center line in a longer side direction of the diaphragm toward two longer sides of the diaphragm.

12. The speaker system according to claim 8, wherein the diaphragm is in the shape of a track, and wherein the diaphragm has a thickness which is reduced from a center line in a longitudinal direction of the diaphragm toward two sides of the diaphragm.

13. The speaker system according to claim 2, wherein the passive radiator further has a weight having a specific gravity larger than a specific gravity of the diaphragm, the weight being fixed on at least one surface of a center portion of the diaphragm.

14. The speaker system according to claim 13, wherein a center-of-gravity position of the diaphragm in a vibration direction of the diaphragm coincides with a center position of a height dimension of the edge in the vibration direction of the diaphragm.

15. The speaker system according to claim 13, wherein the diaphragm is in the shape of a circle, and wherein the weight is in the shape of a circle having a diameter smaller than that of the diaphragm, and is fixed with a center point thereof coinciding with a center point of the diaphragm.

16. The speaker system according to claim 13, wherein the diaphragm is in the shape of a square, wherein the weight is in the shape of a square having a side length shorter than that of the diaphragm, and is fixed with a center point thereof coinciding with a center point of the diaphragm, and wherein each side of the weight is opposed to a corresponding side of the diaphragm.

17. The speaker system according to claim 13, wherein the diaphragm is in the shape of a rectangle, and wherein the weight is in the shape of a rectangle having an outer shape smaller than that of the diaphragm, and is fixed with a center line in a longer side direction thereof coinciding with that of the diaphragm.

18. The speaker system according to claim 13, wherein the diaphragm is in the shape of a track, and wherein the weight is in the shape of a rectangle having an outer shape smaller than that of the diaphragm, and is fixed with a center line in a longer side direction thereof coinciding with a center line in a longitudinal direction of the diaphragm.

19. The speaker system according to claim 2, wherein the cross-sectional shapes of the two edges are roll shapes which are convex and concave with respect to the surface to which the passive radiator is attached, respectively.

20. The speaker system according to claim 1, wherein the diaphragm is an annular diaphragm, wherein the passive radiator includes an inner edge supporting an inner circumference of the diaphragm, and an outer edge supporting an outer circumference of the diaphragm, and wherein the inner edge and the outer edge have cross-sectional shapes with which distortion components of sound pressures radiated from the inner edge and the outer edge are canceled with each other.

21. The speaker system according to claim 20, wherein one of the inner edge and the outer edge has a cross-sectional shape which is a roll shape convex with respect to a surface to which the passive radiator is attached, and the other has a cross-sectional shape which is a roll shape concave with respect to the surface to which the passive radiator is attached.

22. A video audio apparatus comprising:

a display device including a screen;

the speaker system according to claim 1; and a guide structure including a reflector provided in front of the passive radiator, wherein the guide structure guides a sound radiated by the passive radiator of the speaker system toward the screen of the display device using the reflector provided in front of the passive radiator via a gap.

23. A car comprising:

the speaker system according to claim 1; and a car body for holding the speaker system thereinside.

24. A speaker system comprising:

a cabinet;

at least one speaker unit attached to the cabinet; and a plurality of passive radiators attached to the cabinet, the plurality of passive radiators each including a diaphragm and a supporting system that supports the diaphragm in a manner which allows the diaphragm to vibrate, wherein the plurality of passive radiators includes a first passive radiator and a second passive radiator, wherein a cross-sectional shape of the supporting system of the first passive radiator and a cross-sectional shape of the supporting system of the second passive radiator are shaped to be substantially symmetrical to each other about a surface to which the supporting system of the first passive radiator and the supporting system of the second passive radiator are attached so that the supporting system of the first passive radiator and the supporting system of the second passive radiator are configured to cancel a distortion component of a sound pressure radiated from the supporting system of the first passive radiator with a distortion component of a sound pressure radiated from the supporting system of the second passive radiator.

25. The speaker system according to claim 24, wherein the supporting system of the first passive radiator and the supporting system of the second passive radiator include cross-sectional shapes that are the same in a circumferential direction.

26. The speaker system according to claim 25, wherein the supporting system of the first passive radiator has a roll shape which is convex with respect to the surface to which the first passive radiator is attached, and wherein the supporting system of the second passive radiator has a roll shape which is concave with respect to the surface to which the second passive radiator is attached.

27. The speaker system according to claim 24, wherein the diaphragm of at least one of the plurality of passive radiators is an annular diaphragm, wherein the at least one of the plurality of passive radiators includes an inner edge supporting an inner circumference of the diaphragm, and an outer edge supporting an outer circumference of the diaphragm, and wherein the inner edge and the outer edge have cross-sectional shapes with which distortion components of sound pressures radiated from the inner edge and the outer edge are canceled with each other.

28. The speaker system according to claim 27, wherein one of the inner edge and the outer edge has a cross-sectional shape which is a roll shape convex with respect to the surface to which the passive radiator is attached, and the other has a cross-sectional shape which is a roll shape concave with respect to the surface to which the passive radiator is attached.

29. A video audio apparatus comprising:

a display device including a screen;

the speaker system according to claim 24; and a guide structure including a reflector provided in front of the passive radiator, wherein the guide structure guides a sound radiated by the plurality of passive radiators of the speaker system toward the screen of the display device using the reflector provided in front of the passive radiator via a gap.

30. A car comprising:

the speaker system according to claim 24; and a car body for holding the speaker system thereinside.

* * * * *